US006245159B1

(12) United States Patent
Deng

(10) Patent No.: US 6,245,159 B1
(45) Date of Patent: Jun. 12, 2001

(54) VACUUM CLEANER APPARATUS AND RETURN SYSTEM FOR USE WITH THE SAME

(76) Inventor: David Deng, 2668 High Ridge Dr., Chino Hills, CA (US) 91709

( * ) Notice: Subject to any disclaimer, the term of this patent is extended or adjusted under 35 U.S.C. 154(b) by 0 days.

(21) Appl. No.: 09/541,741

(22) Filed: Apr. 3, 2000

Related U.S. Application Data

(63) Continuation-in-part of application No. 09/406,096, filed on Sep. 25, 1999, which is a continuation-in-part of application No. 09/312,929, filed on May 17, 1999.

(51) Int. Cl.[7] ..... A47L 5/14
(52) U.S. Cl. ..... 134/21; 19/331; 19/346
(58) Field of Search ..... 15/331, 345, 346; 134/21

(56) References Cited

U.S. PATENT DOCUMENTS

| | | | |
|---|---|---|---|
| 2,064,344 | 12/1936 | Good | 15/346 |
| 2,475,808 | 7/1949 | Storm, Jr. | 15/346 |
| 3,268,942 | 8/1966 | Rossnan | 15/346 |
| 3,694,848 | 10/1972 | Alcala | 15/346 |
| 3,942,216 | 3/1976 | Minton | 15/331 |
| 5,485,651 | 1/1996 | Payeur | 15/346 X |
| 5,647,092 | 7/1997 | Miwa | 15/346 |
| 6,032,327 | 3/2000 | Oka et al. | 15/346 |

FOREIGN PATENT DOCUMENTS

| | | | |
|---|---|---|---|
| 675674A5 | 10/1990 | (CH) | 15/346 |
| 3010130A1 | 9/1981 | (DE) | 15/346 |
| 4135406A1 | 5/1992 | (DE) | 15/346 |
| 88263 | 4/1965 | (FR) | 15/346 |

*Primary Examiner*—Chris K. Moore
(74) *Attorney, Agent, or Firm*—Henricks, Slavin & Holmes LLP

(57) ABSTRACT

A vacuum cleaner for removing dirt and debris from a floor covering includes a motor that generates a low pressure input air stream and a high pressure output air stream. An inlet directs the input stream such that dirt and debris are drawn into the inlet. The inlet is fluidly connected to a dustbin and filter that removes the dirt and debris from the input stream. Next, the motor converts the low pressure input stream into the high pressure output stream. An output disposed adjacent to the inlet directs the output stream onto the floor covering. The output stream agitates the dirt and debris in the floor covering such that a conventional rolling agitator is unnecessary. Therefore, the vacuum cleaner constructed in accordance with present invention can use a smaller motor, thereby making such vacuum cleaner lighter and quieter to use.

23 Claims, 16 Drawing Sheets

VACUUM CLEANER APPARATUS AND RETURN SYSTEM FOR USE WITH THE SAME

CROSS-REFERENCE OF RELATED APPLICATIONS

This is a continuation-in-part application of U.S. application having an application Ser. No. of 09/406,096 and a filing date of Sep. 25, 1999, which is a continuation-in-part application of a previous application having an application Ser. No. of 09/312,929 and a filing date of May 17, 1999.

BACKGROUND OF THE PRESENT INVENTION

1. Field of the Present Invention

The present invention generally relates to vacuum cleaners, and more particularly to a vacuum cleaner that utilizes exhaust air to agitate dirt and debris prior to being drawn into the vacuum cleaner.

2. Description of the Related Art

Vacuum cleaners are common household appliances that are used for the maintenance and cleaning of carpets and other floor coverings. The vacuum cleaner will have a cleaning head that is drawn over the floor to be cleaned. Disposed within the cleaning head is a 6 to 12 amp electric motor that rotates a fan up to 35,000 rpm to thereby generate a low pressure air stream. The motor is coupled to an inlet disposed in the cleaning head through either a duct or a flexible hose and a dustbin. During operation of the vacuum cleaner, the motor rotates the fan thereby generating the low pressure air stream that draws dust and debris into the inlet, and it is deposited into the dustbin.

In order to facilitate removal of dirt from a carpet, the vacuum cleaner typically uses an agitator disposed next to the inlet. The agitator is typically a cylindrical roller mounted to the cleaning head next to the inlet. Attached along the longitudinal axis of the roller are a series of brushes. The agitator is coupled to the motor with a belt such that as the motor rotates, the agitator will thereby spin at a high rate of speed thereby brushing and agitating the carpet. Such agitation will dislodge dirt and debris contained within the floor covering, thereby facilitating the removal of such into the inlet. Typically, upright vacuum cleaners use a single motor for rotating both the fan and the agitator. As such, the motor typically generates a considerable amount of noise such that the vacuum cleaner can only be used at periods during the day that do not disturb other people. Additionally, the motor may be heavy, thereby causing the appliance to be unwieldy and difficult to draw over the surface to be cleaned.

Furthermore, the configuration of existing vacuum cleaners is such that removal of dirt and debris from the edges of walls and other obstacles such as furniture which rest directly on the floor covering is accomplished only through the use of an accessory hose and adapter piece which the inventor of the present invention has found to be inconvenient and adds to the cumbersome nature of prior art vacuum cleaners.

The present invention addresses the above-mentioned deficiencies in prior are vacuum cleaners by providing a system that uses the unused exhaust air to agitate the dirt and debris in the floor and along the edges of walls and obstacles to be cleaned. As such, the vacuum cleaner of the present invention may use a smaller motor than conventional vacuum cleaners and thereby be more efficient. Additionally the smaller motor will not generate as such noise, thereby permitting vacuuming at any time of the day.

SUMMARY OF THE PRESENT INVENTION

In accordance with the preferred embodiment of the present invention, there is provided a vacuum cleaner for cleaning dirt from a floor. The vacuum cleaner comprises a motor that has an intake and an exhaust port. The motor is operative to generate a low pressure input stream of air through the intake and a high pressure output stream of air through the exhaust port. The intake of the motor is in fluid communication with an inlet disposed adjacent to the floor and operative to draw dirt therefrom with the input stream. Additionally, the vacuum further includes an outlet in fluid communication with the exhaust port. The outlet is disposed adjacent to the inlet and the floor is operative to direct the output stream onto the floor to thereby facilitate removal of dirt therefrom.

In order to filter the incoming dirt and debris, the vacuum cleaner of the present invention may further comprise a filter and dustbin positioned between the inlet and the intake of the motor. The filter and dustbin are configured to collect and filter the dirt and debris in the input stream of air before exiting through the outlet.

The outlet is configured to direct the output streams adjacent to and in relative communication with the inlet streams. Specifically, the outlet comprises a plurality of forward deflection channels that direct the output stream in front of the vacuum cleaner and a plurality of rear deflection channels that agitate the floor covering directly beneath the plurality of inlet channels. A selector directs the output stream through either the forward or rearward deflection channels as is desired.

It is further contemplated that the present invention may be incorporated into an air return attachment for an existing vacuum cleaner. As such, the air return attachment cleaner. The housing also includes an outlet disposed adjacent to the inlet and configured to direct the output stream onto the floor.

In accordance with the present invention, there is provided a method of cleaning dirt from a floor with a vacuum cleaner equipped with the preferred embodiment of the present invention. The method includes the steps of first generating a low pressure input stream of air through an inlet of the vacuum with vacuum's motor. Next, dirt and debris is drawn into the inlet with the input stream and removed by a filter. Then the input stream is converted into a high pressure output stream by the motor and directed onto the floor with an outlet. The output stream facilitates cleaning of the floor by agitating dirt and debris therein. The output stream may be directed toward the inlet during normal operation, or may be directed toward the front of the vacuum cleaner in order to facilitate removal of dirt between the floor and the wall or the other obstacles which may be relatively perpendicular to the floor covering.

DETAILED DESCRIPTION OF THE PREFERRED EMBODIMENT

Figure 1:
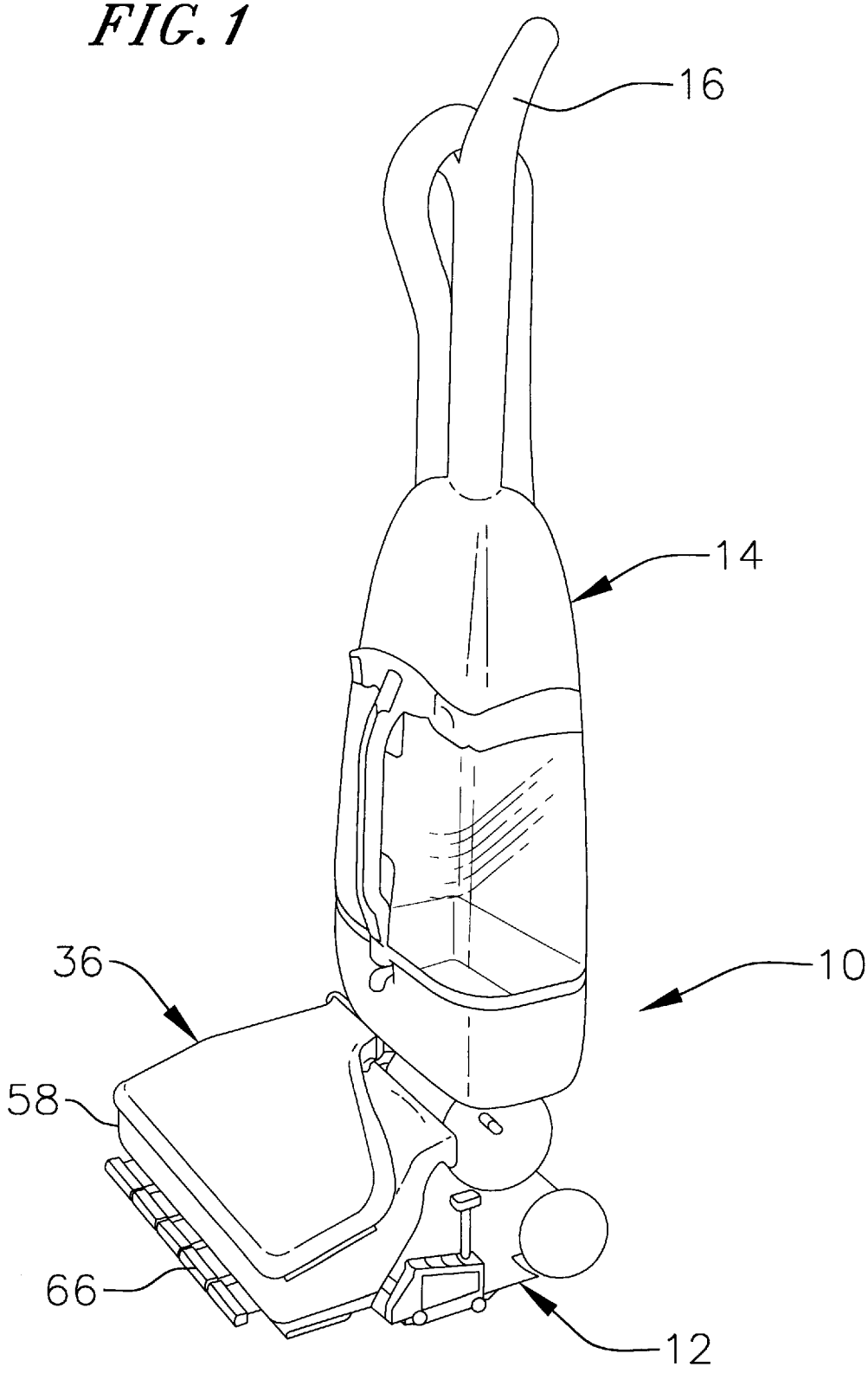
FIG. 1 is a front perspective view of a vacuum cleaner constructed in accordance with a first preferred embodiment of the present invention.

Referring to the drawings wherein the showings are for purpose of illustrating a preferred embodiment of the present invention only, and not for purposes of limiting the same, FIG. 1 perspectively illustrates a vacuum cleaner 10 constructed in accordance with a first preferred embodiment of the present invention. The vacuum cleaner 10 comprises a cleaning head portion 12 and an upright portion 14. The vacuum cleaner 10 is used by pushing the cleaning head portion 12 over the surface or floor covering to be cleaned with a handle 16 attached to the upright portion 14 thereof.

Figure 2:
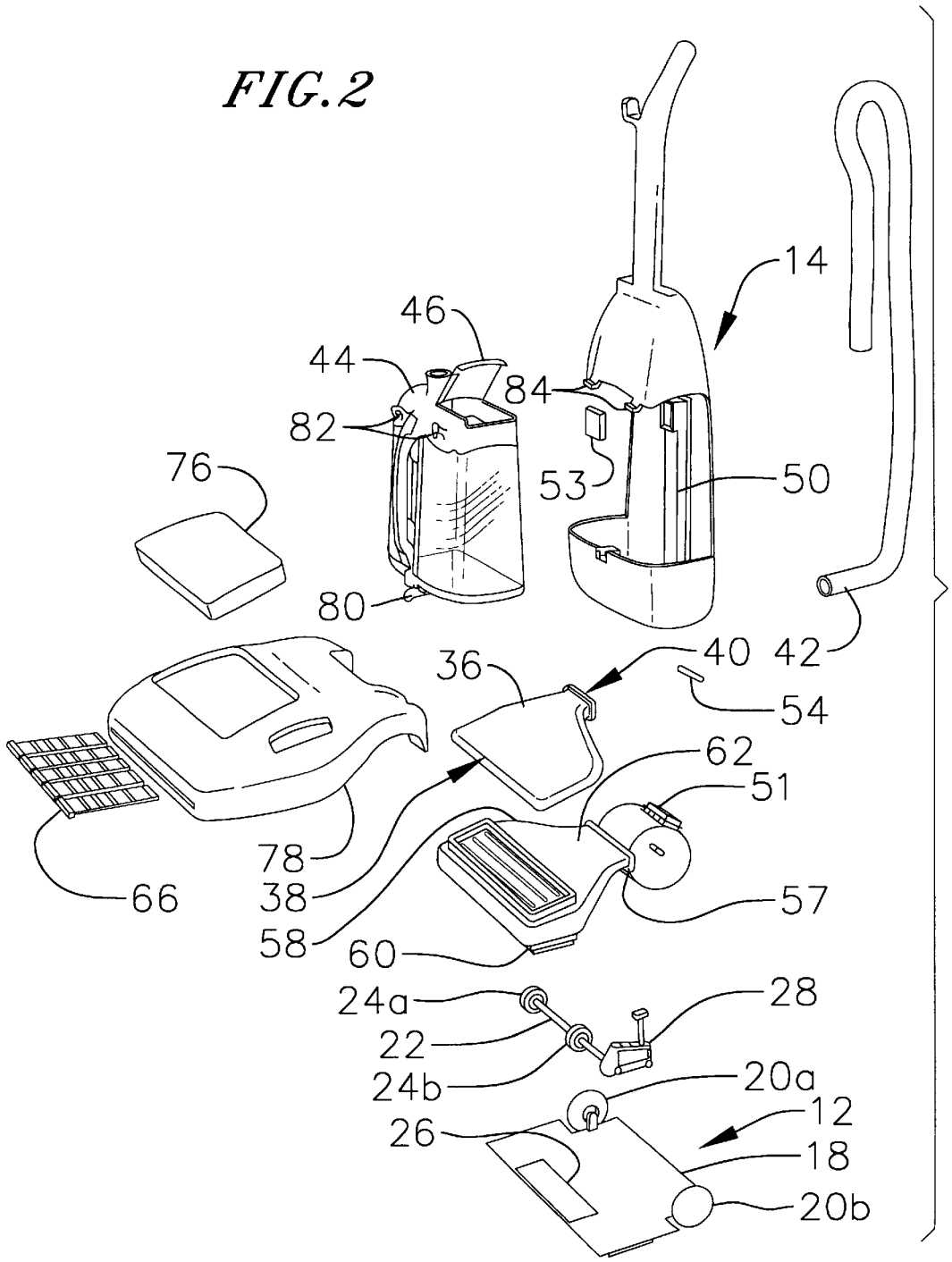
FIG. 2 is an exploded perspective view of the vacuum cleaner according to the above first preferred embodiment of the present invention.

Referring to FIG. 2, the cleaning head portion 12 has a generally rectangular floor plate 18 that supports a pair of rotatable rear wheels 20*a* and 20*b* placed at opposite comers of the floor plate 18. Also attached to the floor plate 18 is a front axle 22 supporting a pair of rotatable front wheels 24*a* and 24*b*. The axle 22 is attached to floor plate 18 in a position whereat each of the front wheels 24*a* and 24*b* protrude through an opening 26 formed within floor plate 18. The front wheels 24*a* and 24*b*, as well as rear wheels 20*a* and 20*b*, are configured to travel and support the floor plate 18 and cleaning head portion 12 above the floor covering. Additionally, the front axle 22 is attached to a vertical height adjustment mechanism 28 that is capable of selectively adjusting the height of the floor plate 18 above the floor covering. Specifically, the height adjustment mechanism 28 can change the vertical spacing between the floor plate 18 and the axle 22 in order to move the cleaning head portion 12 either closer to or further away from the floor covering.

Figure 3:
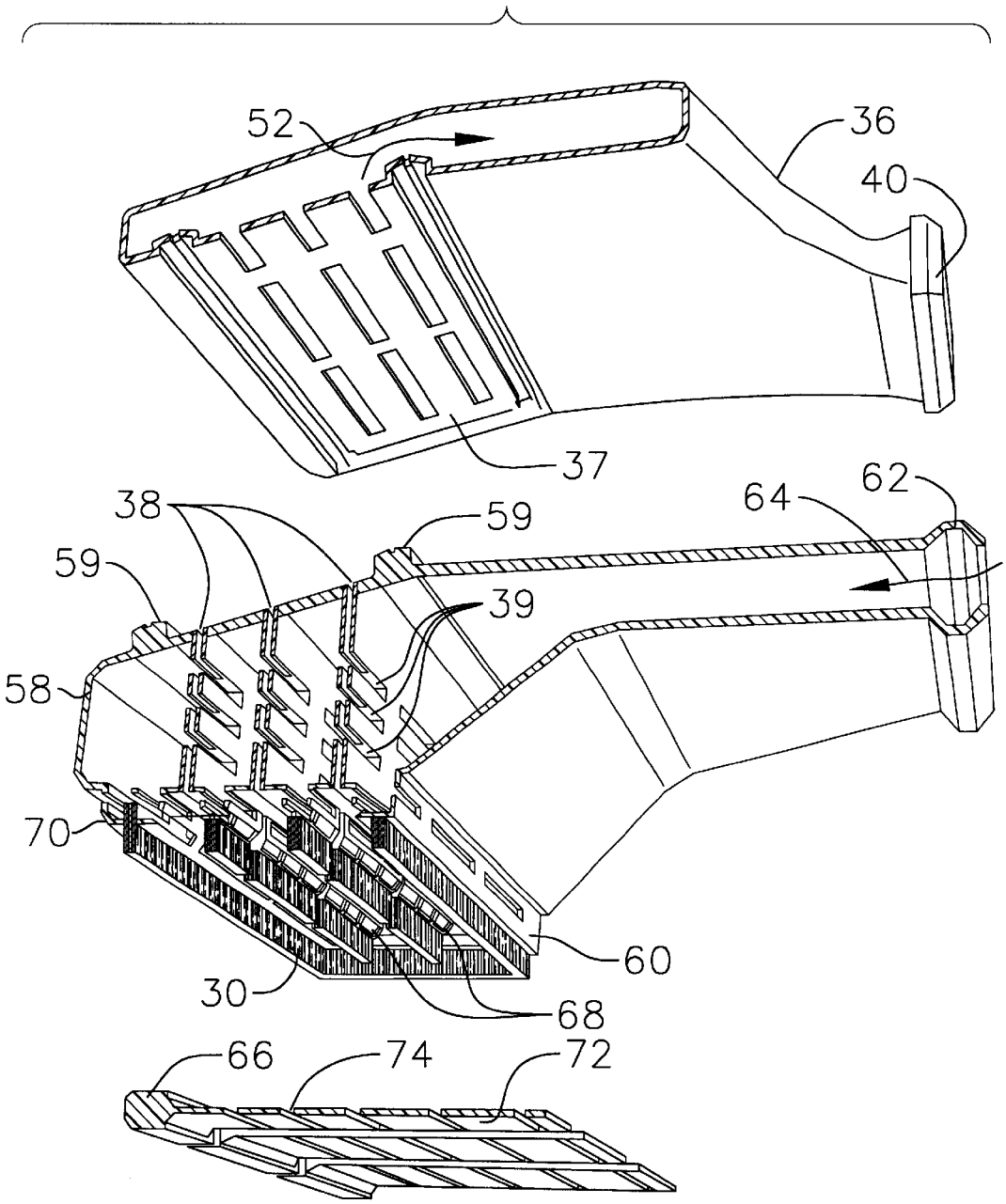
FIG. 3 is a sectional perspective view of the air inlet an defection channels of the vacuum cleaner according to the above first preferred embodiment of the present invention.
Figure 4A:
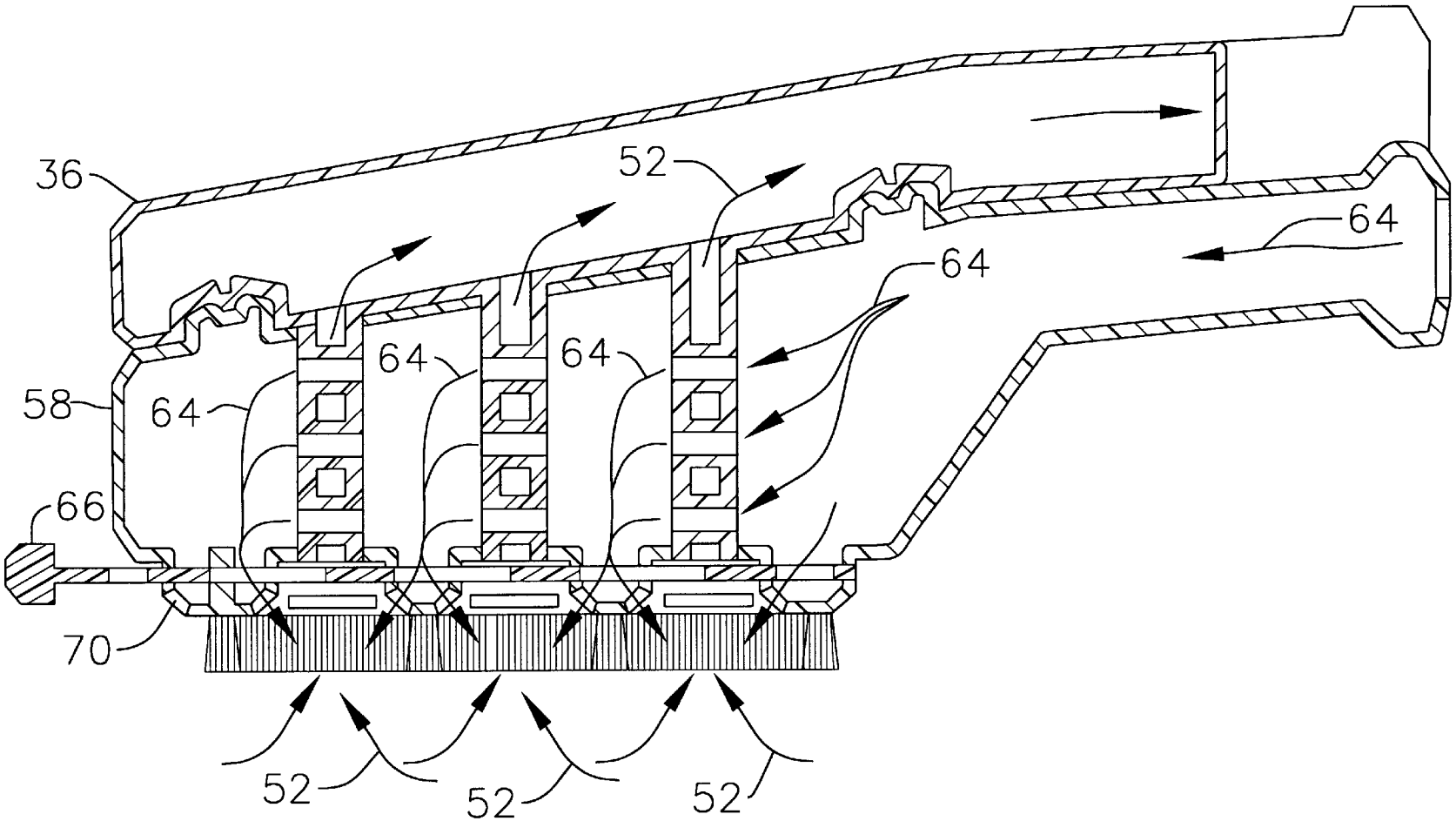
FIGS. 4A and 4B are sectional views of the inlet and deflection channels for the vacuum cleaner according to the above first preferred embodiment of the present invention.
Figure 4B:
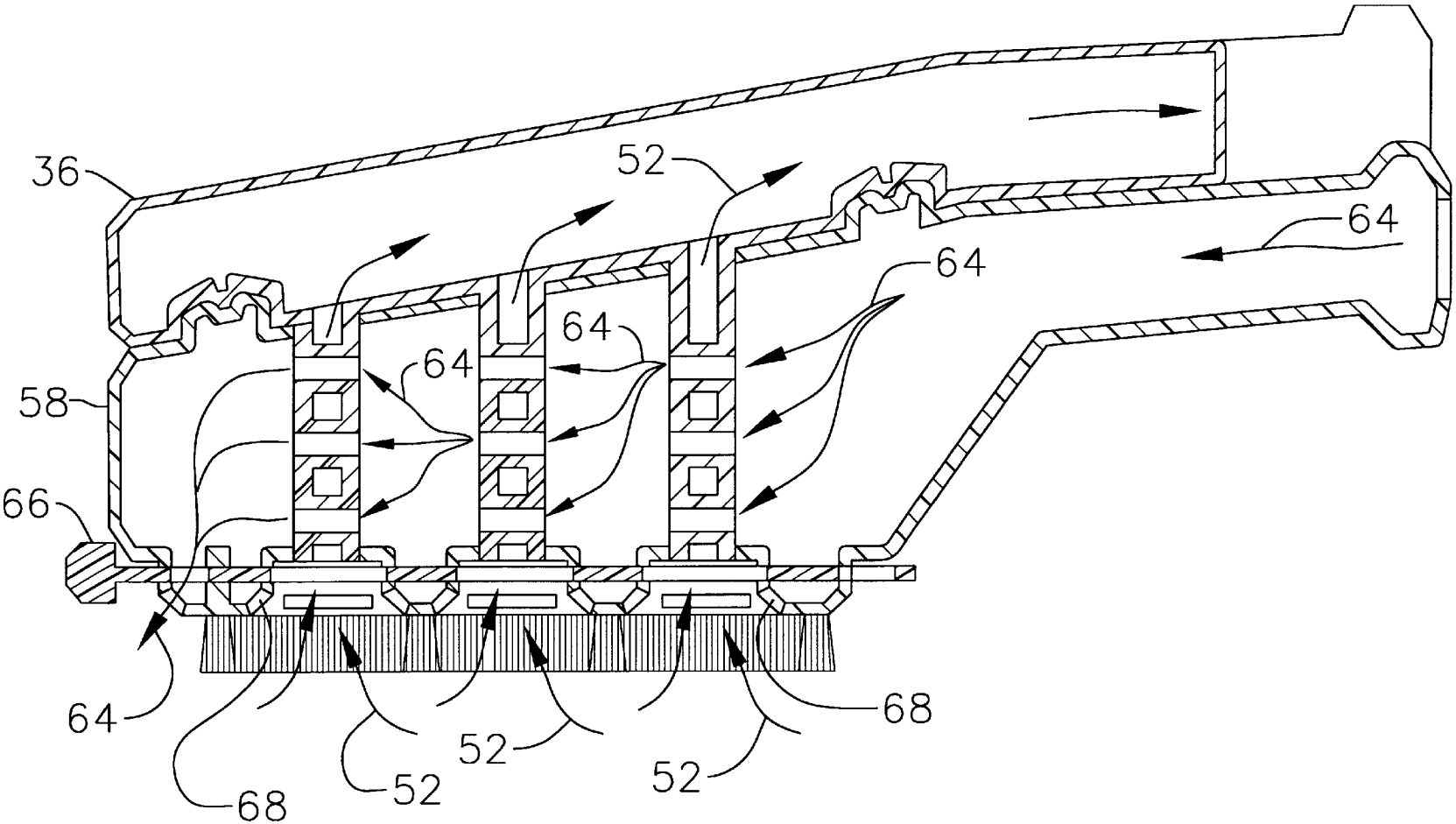

Referring to FIG. 3 and FIGS. 4*a* and 4*b*, disposed adjacent to the air inlet aperture extension 38 and the rearward air deflection channel 68 are rows of brushes 30, positioned such that they will further aid in the agitation process of the floor covering and will also serve to contain most of the output air stream 64 in the area directly under the air return outlet 58.

As seen in FIG. 3, the air inlet 36 has a generally hollow, bell shaped configuration whereby a lower portion thereof is shaped as an elongate rectangular base 37 with a plurality of openings adapted to be in fluid communication with the air inlet aperture extensions 38 which are disposed vertically through the air return outlet 58. The low pressure input stream 52 is maintained within the inlet aperture extensions 58 and the air inlet 36 by way of an air tight seal 59. Additionally, the upper portion is angled approximately ninety relative to the bottom portion, and tapers to an upper orifice 40 to be in fluid communication with a flexible hose 42.

In the first preferred embodiment of the present invention, the hose 42 is coupled between the inlet 36 and a top attachment point of an airtight dustbin 44. As seen in FIG. 2, the dustbin 44 is attachable to the upright portion 14 of vacuum cleaner 10 through the use of a springclip 80, slots 82 and tabs 84. The tabs 84 of upright portion 14 are insertable into the slots 82 of dustbin 44 such that the dustbin 44 can be swung into place on upright portion 14. The springclip 80 thereby frictionally secures the dustbin 44 to the upright portion 14. The dustbin 44 is an airtight container that uses a loose plastic mesh to collect debris that is drawn into the air inlet 36 and hose 42. The dustbin 44 includes a hinged lid 46 that is openable to provide access into the container for removal of dirt and debris when the dustbin 44 is removed from the upright portion 14.

In order to draw dirt and debris into the dustbin 44, the vacuum cleaner 10 is equipped with a blower or motor 48 fluidly connected to the dustbin 44 through a duct 50. The duct 50 is formed within the upright portion 14 and fluidly connects the dustbin 44 to an intake 51 of the motor 48. The motor 48 contains fan (not shown) that rotates to produce a low pressure input streams 52 of air as seen in FIGS. 4*a* and 4*b*. The low pressure input stream 52 draws dust and debris through the inlet 36 and hose 42 such that the dust and debris is deposited within the dustbin 44. In order to trap the dust within the dustbin 44, there is provided a first filter 53 disposed between the dustbin 44 and the duct 50. Additionally, a second filter 54 is disposed between the duct 50 and the intake 51 of motor 48. The second filter B54 is located within a flexible coupling 55 that attaches intake 51 of the motor 48 to the duct 50. The first 53 and second 54 filters prevent debris from entering and damaging the motor 48 as well as the trap dust.

The motor 48 produces an output stream 64 of air through an exhaust port 57 of motor 48. The exhaust port 57 is fluidly connected to an air return outlet 58 that is a generally hollow, bell shaped housing that has a narrowed upper portion 62 angled approximately ninety degrees to a rectangular lower portion 60. The outlet 58 directs an output stream 64 of air past the inlet aperture extensions 38 by way of a plurality of inlet bypass channels 39 and then continues through either a plurality of rearward deflection channels 68 or a forward deflection channel 70, as seen in FIG. 3 and FIGS. 4*a* and 4*b*. In the first preferred embodiment of the present invention, the rearward deflection channels 68 are configured to direct the output streams 64 toward the floor covering directly beneath the air inlet aperture extensions 38 which occupy the spaces between the rows of rearward deflection channels 68. The output stream 64 can be deflected into either the forward deflection channel 70 or the plurality of rearward deflection channels 68, depending upon the position of a selector or slidable edge detection button 66. The edge detection button 66 has a closed portion 72 that blocks the output stream 64 from entering a respective channel and an open portion 74 that allows output stream 64 to enter a respective channel. Therefore, by laterally sliding the edge detection button 66 between the rear deflection channels 68 and forward deflection channel 70, the output stream 64 can be directed through a respective channel. In the first preferred embodiment of the present invention, the detection button 66 is positioned to allow the output stream 64 to exit through the rear deflection channels 68 during normal vacuuming. However, as seen in FIG. 4*b*, if the vacuum cleaner is pressed up against a wall, the edge detection button 66 will contact the wall and slide rearward thereby closing the rear deflection channels 68 and opening the forward detection channel 70. As such, the output stream 64 will be directed towards the front of the vacuum cleaner 10 to thereby blow out dirt and debris that has collected between the wall (or other obstacle) and the floor that can then be collected by the air inlet aperture extensions 38. Therefore, the vacuum cleaner 10 constructed in accordance with the present invention does not need special tools or attachments for cleaning the junction between the wall and the floor.

Since the vacuum cleaner 10 constructed in accordance with the first preferred embodiment of the present invention reuses the exhaust output stream 64, the motor 48 may be sized appropriately. As will be recognized to those of ordinary skill in the art, the motor 48 may be smaller and consume less energy than a conventional vacuum cleaner since it does not power a spinning agitator. Therefore, it is contemplated that the motor 48 may be powered by a rechargeable battery 76 mounted within a hood 78. As seen in FIG. 2, the hood 78 covers the top of the cleaning head portion 12 when attached thereto. The battery 76 is attached to the top of the hood 78 for easy recharging and ideal weight distribution. If the vacuum cleaner 10 is used with a battery 76, then the battery 76 will be designed to operate at 12 volts, 7 amp/hours for the duration of at least 1 hour in order to sustain the motor 48 with 120 volts at 6 amps and spinning at 25,000 RPM.

Figure 5:
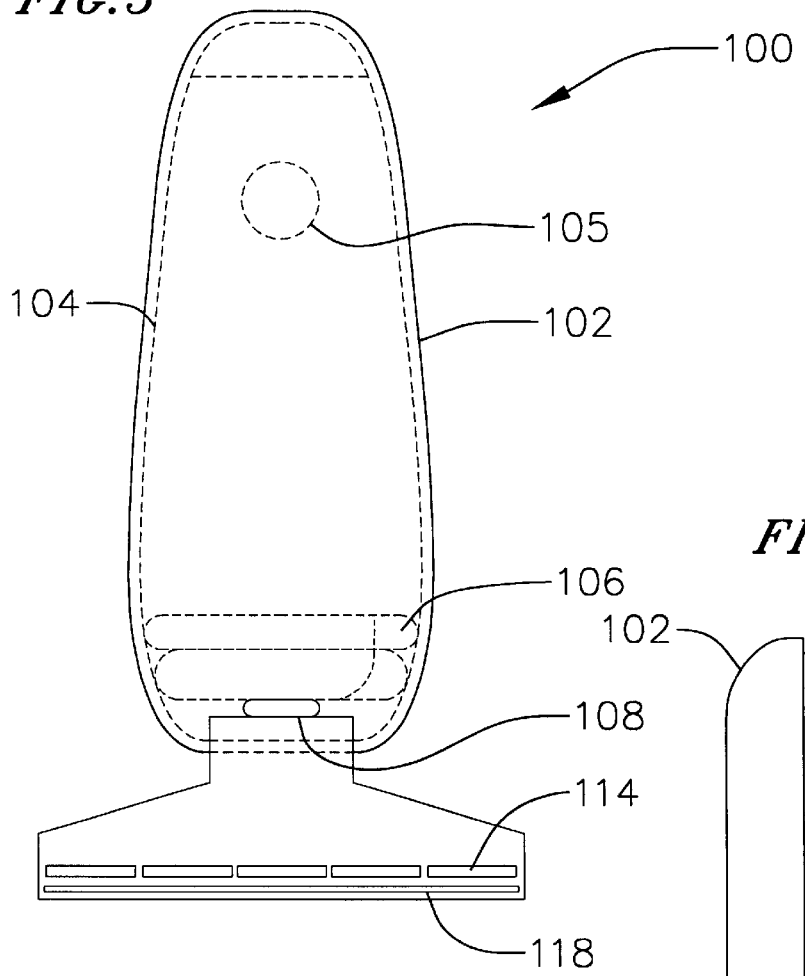
FIG. 5 is a front view of the vacuum cleaner attachment constructed according to the above first preferred embodiment of the present invention.
Figure 6:
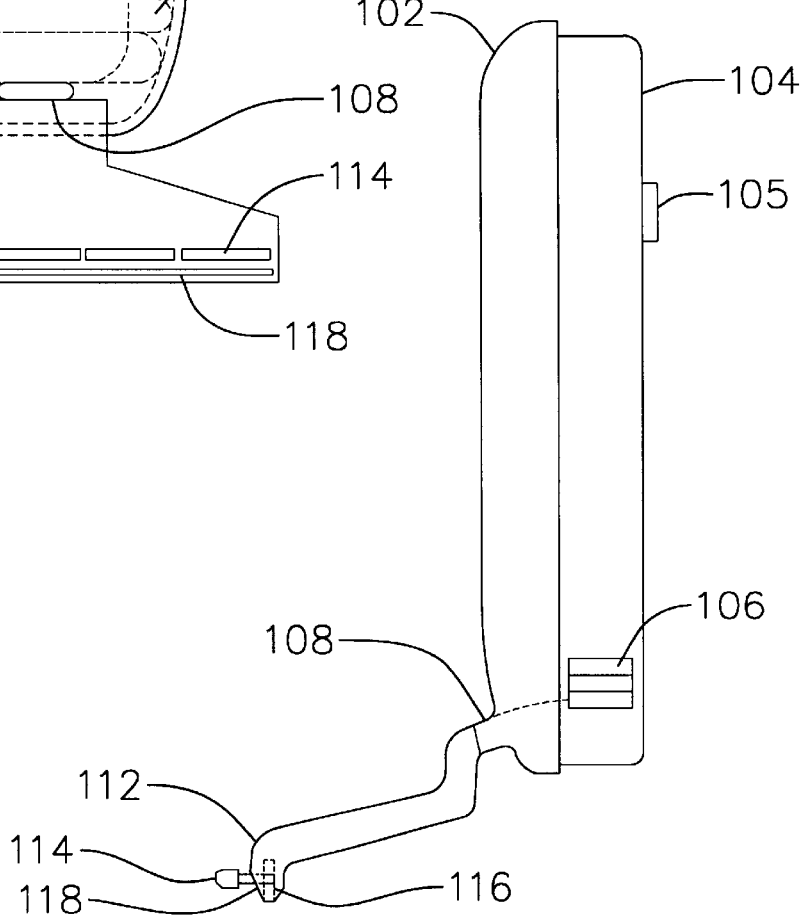
FIG. 6 is a side view of the vacuum cleaner attachment according to the above first preferred embodiment of the present invention.
Figure 7:
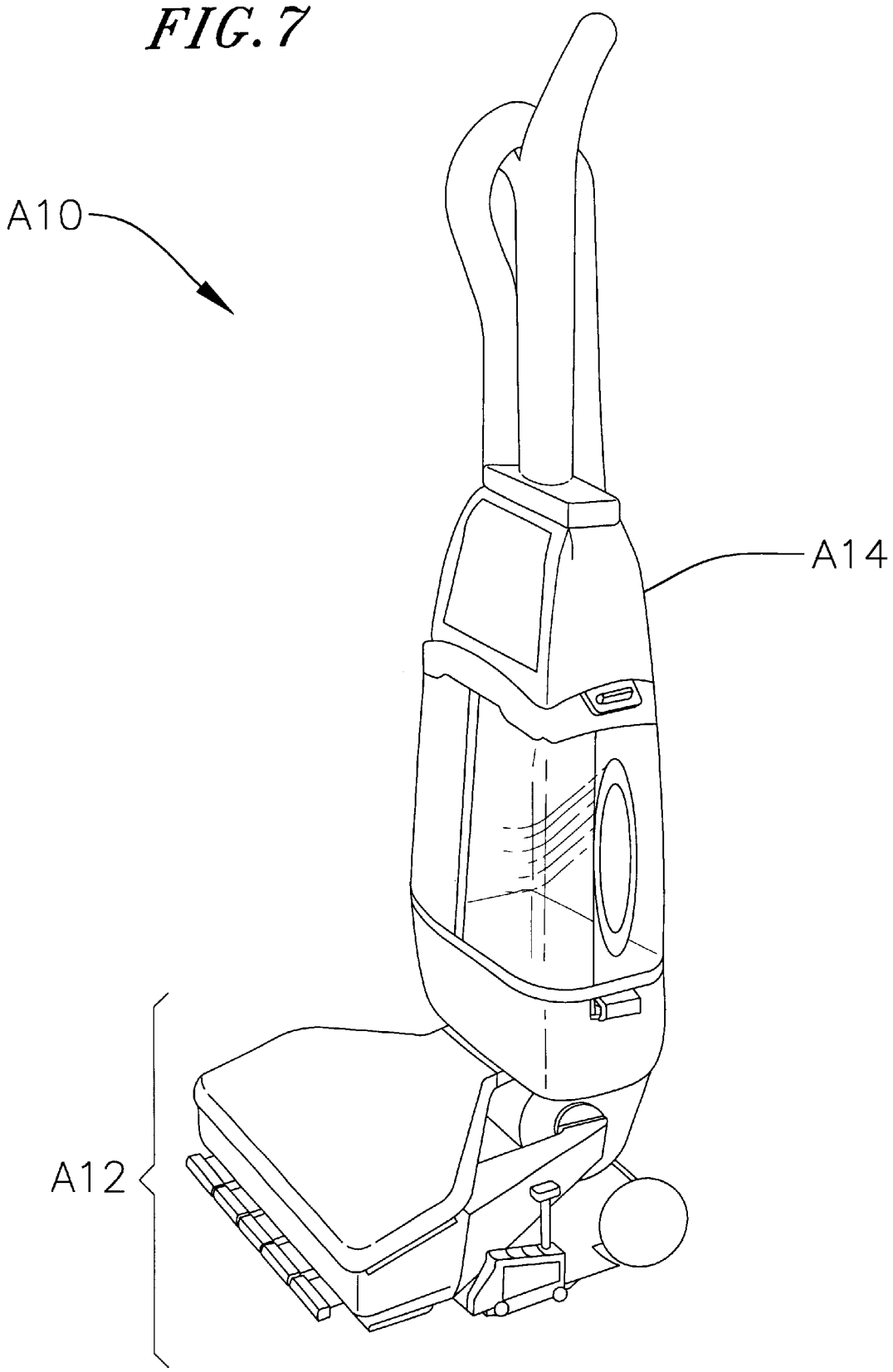
FIG. 7 is a perspective view of a vacuum cleaner constructed in accordance with a second preferred embodiment of the present invention.

Referring to FIG. 5 and FIG. 6, the vacuum cleaner 10 of the present invention is also provided an air return accessory 100 for attachment to an existing vacuum cleaner. The air return accessory 100 comprises a front housing 102 that is attachable to the upright portion of an existing vacuum cleaner such as an Eureka World VAC. Specifically, the front housing 102 replaces the existing upright body cover and disposable bag of the vacuum cleaner. The front housing 102 snaps into the upright portion using a standard spring loaded handle/clip apparatus (not shown). The front housing 102 contains an airtight accessory dustbin 104 that is coupled to the inlet of the existing vacuum cleaner through adaptive orifice 105. The input air flows through the dustbin 104 and is filtered by an accessory filter 106 before exiting the dustbin 104 through accessory exhaust opening 108. An accessory outlet 110 is coupled to the accessory exhaust 108 in order to direct the exhaust toward the existing air inlet of the vacuum cleaner. The accessory outlet 110 has a forward lip 112 that projects downwardly in front of the air inlet of the existing vacuum cleaner. Additionally, the accessory outlet 110 is configured with an accessory edge detection button 114 that directs the output stream either forward or rearward. The accessory outlet 110 and accessory edge detection button 114 operate identically to the edge detection button 66 and outlet 58 of the vacuum 10. The accessory edge detection button 144 will direct the exhaust stream rearward through an accessory rear channel 116 during normal operation and forward through an accessory forward channel 118 when the accessory outlet 110 is in contact with a wall or obstruction and the accessory edge detection button 114 is depressed. When the accessory dustbin 104 has been filled with dust and debris, it may be emptied through a hinged lid (not shown).

Referring to FIGS. 7 to 11, a second preferred embodiment of the present invention is illustrated. The vacuum cleaner A10 of the second embodiment is a modified mode of the above first preferred embodiment that basically constructs as the above first embodiment to comprise a cleaning head A12 and an upright portion A14. The vacuum cleaner A10 of the present invention is used by pushing the cleaning head portion A12 over the surface of floor covering to be cleaned with a handle A16 attached to the upright portion A14 thereof.

Figure 8:
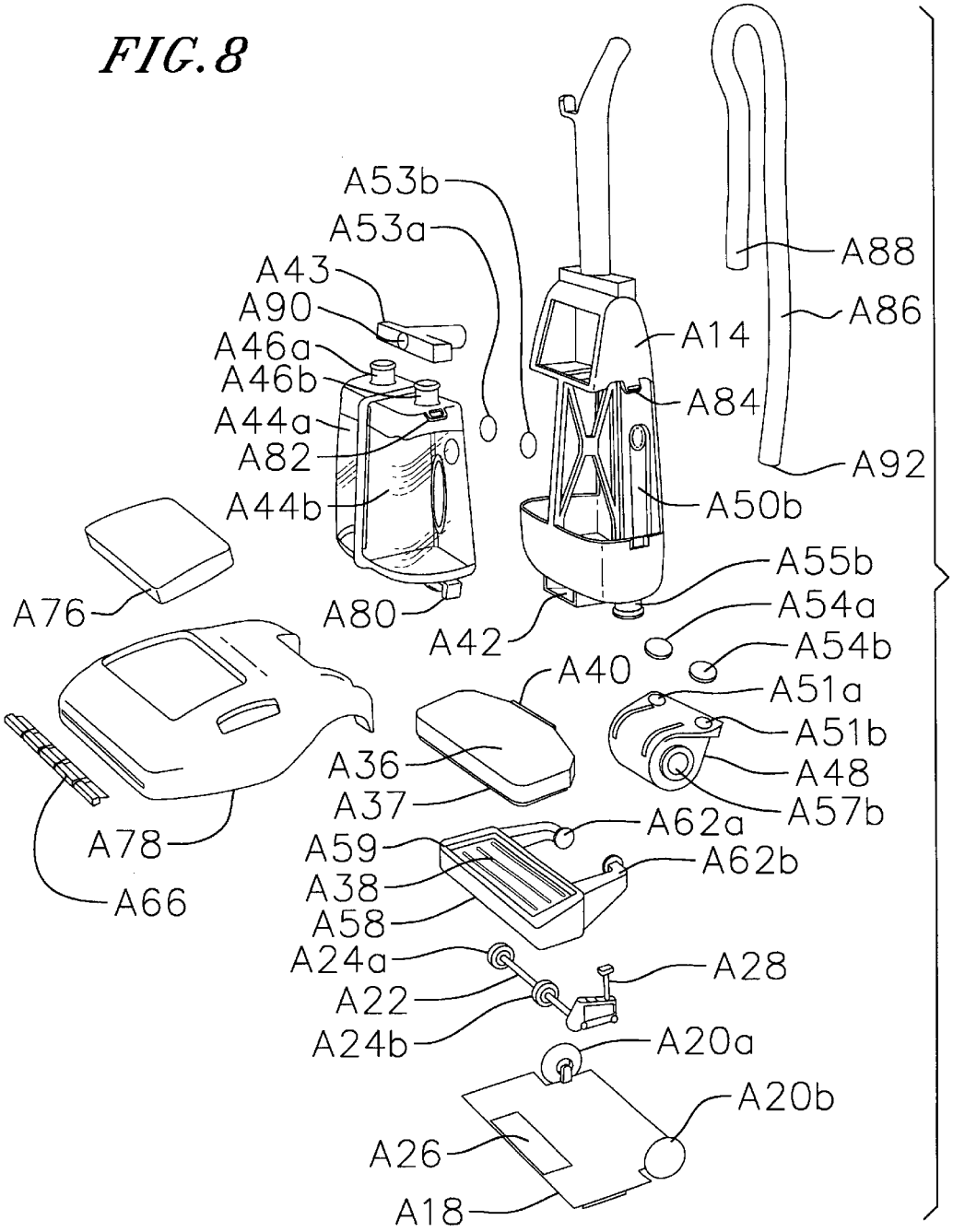
FIG. 8 is an exploded perspective view of the vacuum cleaner according to the above preferred embodiment of the present invention.

Referring to FIG. 8, similar to the above first embodiment, the cleaning head portion A12 has a generally rectangular floor plate A18 that supports a pair of rotatable rear wheels A20*a* and A20*b* placed at opposite corners of the floor plate A18. Also attached to the floor plate A18 is a front axle A22 supporting a pair of rotatable front wheel A24*a* and A24*b*. The axle A22 is attached to floor plate A18 in a position whereat each of the front wheels A24*a* and A24*b* protrude through an opening A26 formed within the floor plate A18. The front wheels A24*a* and A24*b*, as well as rear wheels A20*a* and A20*b*, are configured to travel and support the floor plate A18 and cleaning head portion A12 above the floor covering. Additionally, the front axle A22 is attached to a vertical height adjustment mechanism A28 that is capable of selectively adjusting the height of the floor plate A18 above the flooring covering. Specifically, the height adjustment mechanism A28 can change the vertical spacing between the floor plate A18 and the axle A22 in order to move the cleaning head portion A12 either closer to or further away from the floor covering.

Referring to FIGS. 8 to 11, the major modifications of the second embodiment with respect to the above first embodiment is to provide a blower or motor assembly A48 containing a pair of intakes A51*a* and A51*b* disposed on two opposite sides and an air return outlet A58 having a pair of upper portions A62*a* and A62*b* which are connected to the two intakes A51*a* and A51*b* of the motor assembly A48.

Figure 9:
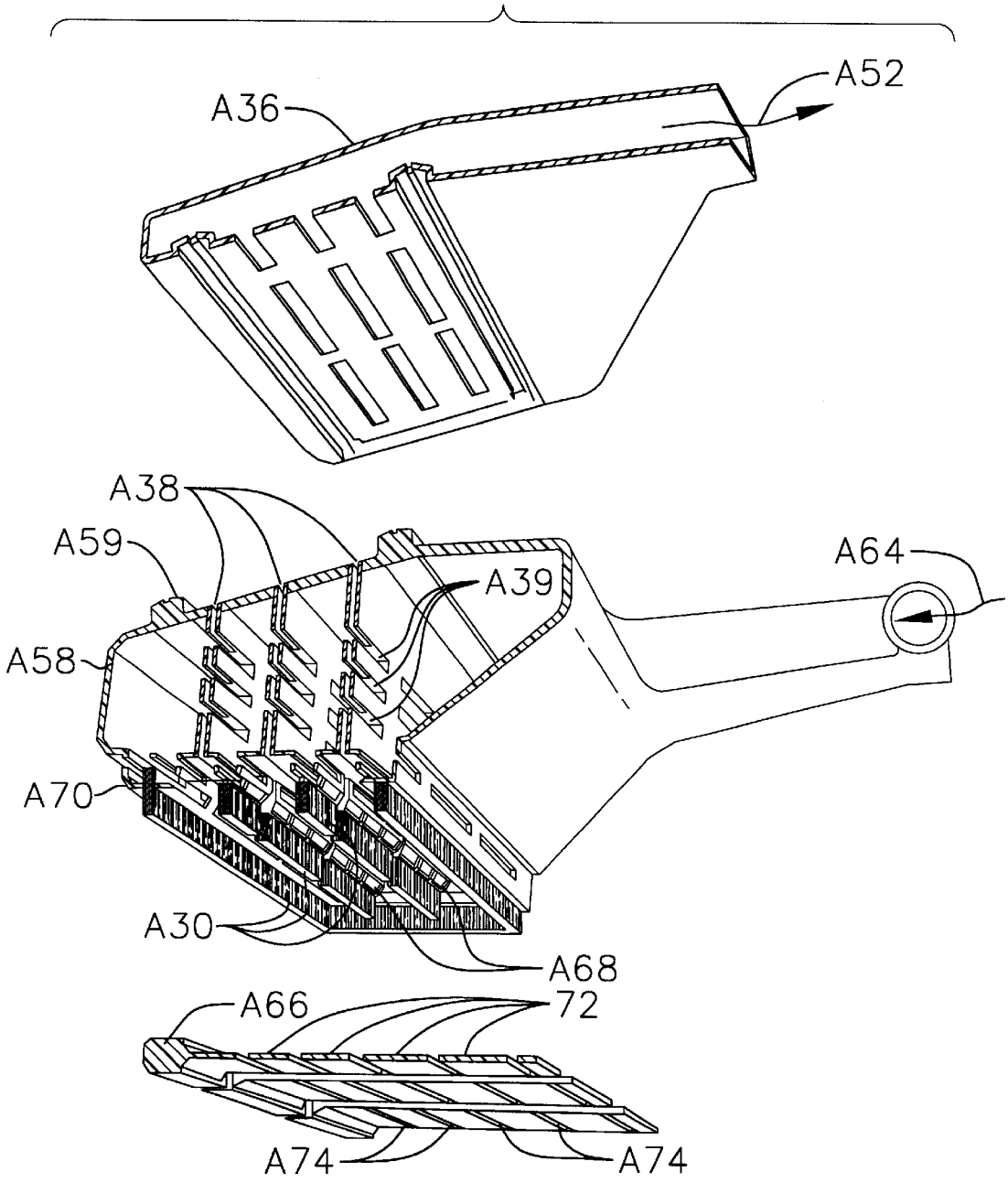
FIG. 9 is a sectional perspective view of the air inlet an defection channels of the vacuum cleaner according to the above second preferred embodiment of the present invention.

Referring to FIG. 8 and FIG. 9, disposed adjacent to the air inlet aperture extension A38 and the rearward air deflection channel A68 are rows of brushes A30, positioned such that they will further aid in the agitation process of the floor covering and will also serve to contain most of the output air stream A64 in the area directly under the air return outlet A58.

As seen in FIG. 8, the air inlet A36 has a generally hollow, bell shaped configuration whereby a lower portion thereof is shaped as an elongate rectangular base A37 with a plurality of openings adapted to be in fluid communication with the air inlet aperture extensions A38 which are disposed vertically through the air return outlet A58. The low pressure input stream A52 is maintained within the inlet aperture extensions A58 and the air inlet 36 by way of an air tight seal A59. Additionally, the upper portion is angled approximately ninety relative to the bottom portion, and tapers to an upper orifice A40 to be in fluid communication with an intake orifice A42 in the upright portion A14.

In the second preferred embodiment of the present invention, the intake orifice A42 is in fluid communication between the inlet A36 and a top attachment adapter A43 of one or two airtight dustbins A44*a* and A44*b*. As seen in FIG. 8, the dustbins A44*a* and A44*b* are attachable to the upright portion A14 of vacuum cleaner A10 through the use of a springclip A80, slots A82 and tabs A84. The tabs A84 of upright portion A14 are insertable into the slots A82 of dustbins A44*a* and A44*b* such that the dustbins A44*a* and A44*b* can be swung into place on upright portion A14. The springclip A80 thereby frictionally secures the dustbins A44*a* and A44*b* to the upright portion A14. The dustbins A44*a* and A44*b* are airtight containers that uses a loose plastic mesh (not shown) to collect debris that is drawn into the air inlet A36, intake orifice A42 and finally the dustbins A44*a* and A44*b*. The dustbins A44*a* and A44*b* include a hinged lids A46*a* and A46*b* that are openable to provide access into the container for removal of dirt and debris when the dustbins A44*a* and A44*b* is removed from the upright portion A14.

In order to draw dirt and debris into the dustbin A44, the vacuum cleaner A10 is equipped with a blower or motor assembly A48 fluidly connected to the dustbins A44*a* and A44*b* through ducts A50*a* (not shown) and A50*b*. The ducts A50*a* and A50*b* are formed within the base of the dustbins A44*a* and A44*b* and are fluidly connected to the intake A51*a* and A51*b* of the motor assembly A48.

Figure 10:
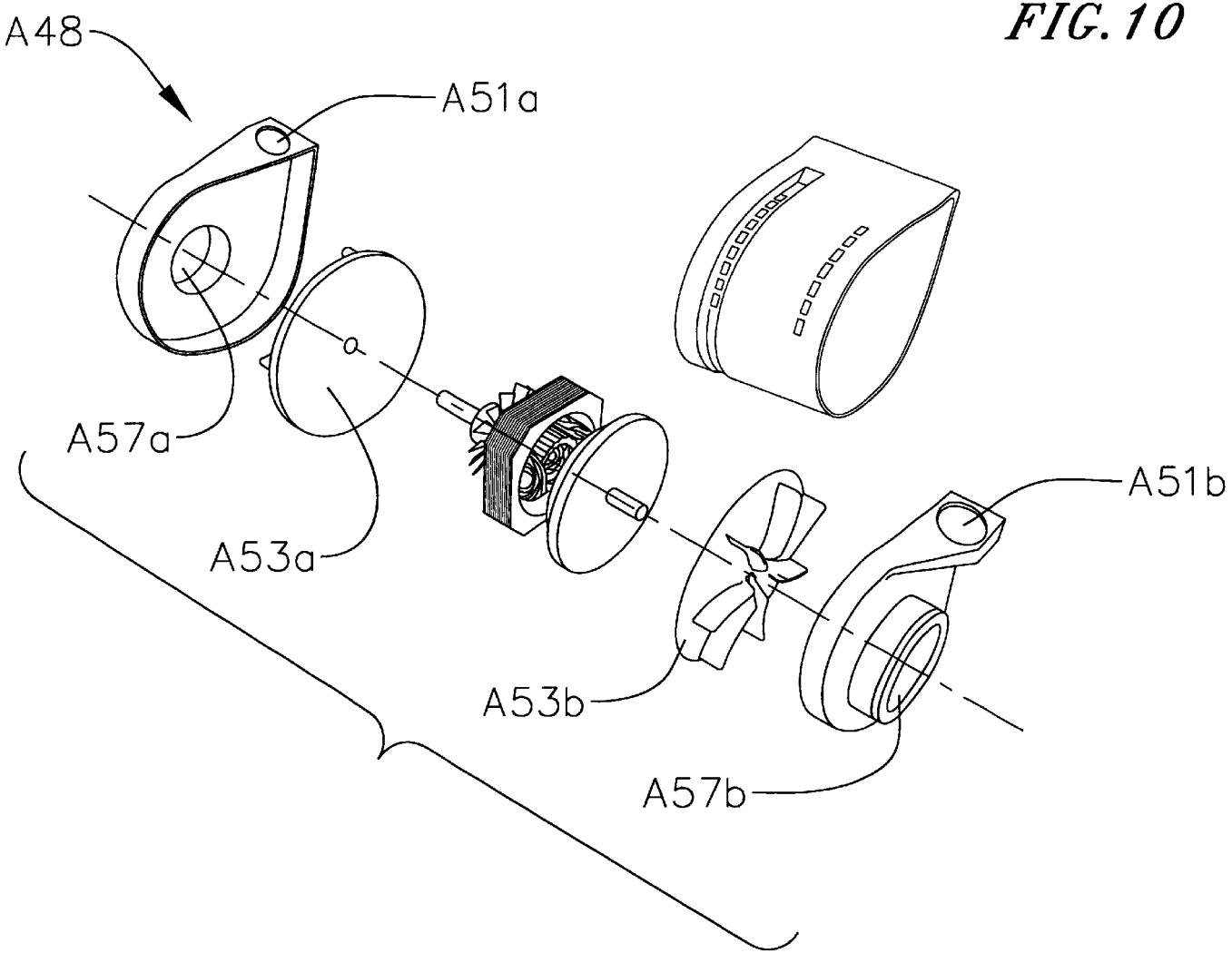
FIG. 10 is an exploded perspective view of the motor according to the above second preferred embodiment of the present invention.
Figure 11:
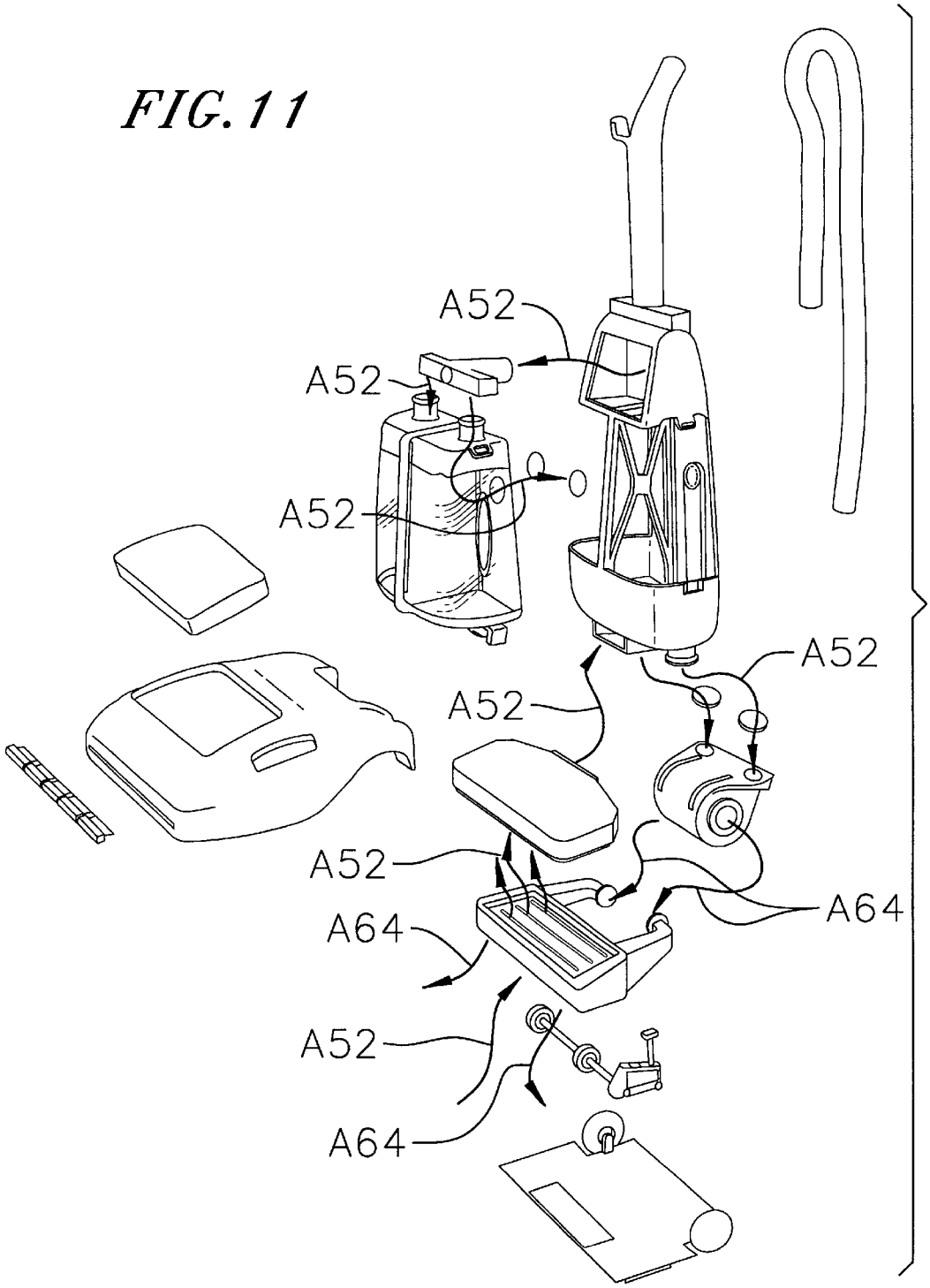
FIG. 11 is an exploded perspective view of the air stream through the vacuum cleaner according to the above second preferred embodiment of the present invention.

Referring to FIG. 10, the motor assembly A48 contains two fans that rotate to produce a low pressure input streams A52 of air. The low pressure input stream A52 draws dust and debris through the inlet A36 and hose 42 such that the dust and debris is deposited within the dustbins A44*a* and A44*b*. In order to trap the dust within the dustbins A44*a* and A44*b*, filters A53*a* and A53*b* are disposed between the ducts A50*a* and A50b the dustbins A44*a* and A44*b* (respectively). Accordingly, the filters A54*a* and A54*b* are located within flexible couplings A55*a* (not shown) and A55*b* that attach intakes A51*a* and A5l*b* of the motor assembly A48 to the ducts A50*a* and A50*b* (respectively). The first A53*a* and A53*b* and second A54*a* and A54*b* filters prevent debris from entering and damaging the motor assembly A48 as well as prevent dust from being expelled into the room.

The motor assembly A48 produces an output stream A64 of air through an exhaust port A57*a* and A57*b* of motor assembly A48. The exhaust ports A57*a* and A57*b* are fluidly connected to an air return outlet A58 that is a generally hollow, bell shaped housing that has a narrowed upper portions A62*a* and A62*b* angled approximately ninety degrees to a rectangular lower portion A60.

According to the second embodiment of the present invention, which similar to the first embodiment of the present invention as seen in FIG. 4*a* and FIG. 4*b*, the outlet A58 directs an output stream A64 of air past the inlet aperture extensions A38 by way of a plurality of inlet bypass channels A39 and then continues through either a plurality of rearward deflection channels A68 or a forward deflection channel A70. In the second preferred embodiment of the present invention, the rearward deflection channels A68 are configured to direct the output streams A64 toward the floor covering directly beneath the air inlet aperture extensions A38 which occupy the spaces between the rows of rearward deflection channels A68. The output stream A64 can be deflected into either the forward deflection channel A70 or the plurality of rearward deflection channels A68, depending upon the position of a selector or slidable edge detection button A66. The edge detection button A66 has a closed portion A72 that blocks the output stream A64 from entering a respective channel and an open portion A74 that allows output stream A64 to enter a respective channel. Therefore, by laterally sliding the edge detection button A66 between the rear deflection channels A68 and forward deflection channel A70, the output stream A64 can be directed through a respective channel. In the second preferred embodiment of the present invention, the detection button A66 is positioned to allow the output stream A64 to exit through the rear deflection channels A68 during normal vacuuming. However, if the vacuum cleaner is pressed up against a wall, the edge detection button A66 will contact the wall and slide rearward thereby closing the rear deflection channels A68 and opening the forward detection channel A70. As such, the output stream A64 will be directed towards the front of the vacuum cleaner A10 to thereby blow out dirt and debris that has collected between the wall (or other obstacle) and the floor that can then be collected by the air inlet aperture extensions A38. Therefore, the vacuum cleaner A10 constructed in accordance with the present invention does not need special tools or attachments for cleaning the junction between the wall and the floor.

Under circumstances where the use of an accessory extension would be the preferred method of vacuuming, a flexible hose A86 is provided with nozzle A88 which can be readily coupled to the top attachment adapter A43 by way of a nozzle orifice A90. The nozzle A88 is constructed such that when inserted into the nozzle orifice A90, fluid communication between the inlet A36 and the dustbins A44*a* and A44*b* is interrupted, thereby establishing fluid communication between a hose inlet A92 and the dustbins A44*a* and A44*b*.

Since the vacuum cleaner A10 constructed in accordance with the second preferred embodiment of the present invention reuses the exhaust output stream A64, the motor assembly A48 may be sized appropriately. As will be recognized to those of ordinary skill in the art, the motor assembly A48 may be smaller and consume less energy than a conventional vacuum cleaner since it does not power a spinning agitator. Therefore, it is contemplated that the motor assembly A48 may be powered by a rechargeable battery A76 mounted within a hood A78. As seen in FIG. 8, the hood A78 covers the top of the cleaning head portion A12 when attached thereto. The battery A76 is attached to the top of the hood A78 for easy recharging and ideal weight distribution. If the vacuum cleaner A10 is used with a battery 76, then the battery A76 will be designed to operate for a sufficient duration in order to sustain the motor assembly A48 with specifications of about 24 volts at 6 amps and spinning at 8,600 RPM.

Under circumstances where a cord powered vacuum is more desirable, the motor assembly A48 will be designed to operate indefinitely, sustaining usage of 120 volts at 6 amps and spinning at approximately 11,000 RPM.

Accordingly, the vacuum cleaner A10 of the second embodiment of the present invention is also provided an air return accessory A100 for attachment to an existing vacuum cleaner, as shown in FIGS. 5 and 6 with respect to the first embodiment of the present invention. The air return accessory A100 comprises a front housing A102 that is attachable to the upright portion of an existing vacuum cleaner such as an Eureka World VAC. Specifically, the front housing A102 replaces the existing upright body cover and disposable bag of the vacuum cleaner. The front housing A102 snaps into the upright portion using a standard spring loaded handle/clip apparatus (not shown). The front housing A102 contains an airtight accessory dustbin A104 that is coupled to the inlet of the existing vacuum cleaner through adaptive orifice A105. The input air flows through the dustbin A104 and is filtered by an accessory filter A106 before exiting the dustbin A104 through accessory exhaust opening A108. An accessory outlet A110 is coupled to the accessory exhaust A108 in order to direct the exhaust toward the existing air inlet of the vacuum cleaner. The accessory outlet A110 has a forward lip A112 that projects downwardly in front of the air inlet of the existing vacuum cleaner. Additionally, the accessory outlet A110 is configured with an accessory edge detection button A114 that directs the output stream either forward or rearward. The accessory outlet A110 and accessory edge detection button A114 operate identically to the edge detection button A66 and outlet A58 of the vacuum A10. The accessory edge detection button A144 will direct the exhaust stream rearward through an accessory rear channel A116 during normal operation and forward through an accessory forward channel A118 when the accessory outlet A110 is in contact with a wall or obstruction and the accessory edge detection button A114 is depressed. When the accessory dustbin A104 has been filled with dust and debris, it may be emptied through a hinged lid (not shown).

Referring to FIGS. 12 to 17, a vacuum cleaner B10 according to a third embodiment of the present invention is illustrated. The vacuum cleaner B10 comprises an agitator B30, which is disposed within an opening B26 and adjacent to front wheels B24*a* and B24*b*, having a first row of brushes B32*a* and a second row of brushes B32*b* disposed on the exterior surface of the agitator B30.

Figure 12:
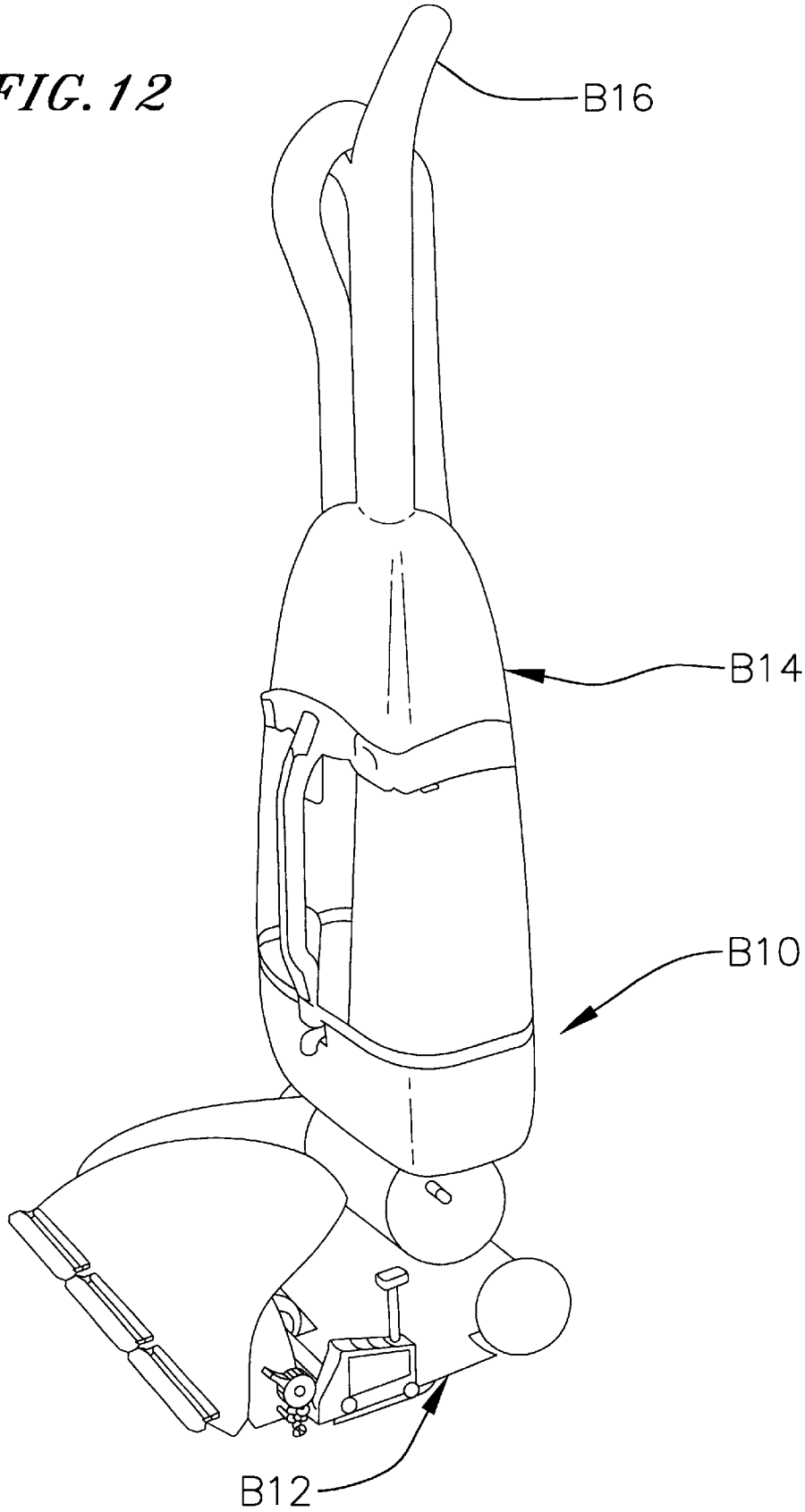
FIG. 12 is a perspective view of a vacuum cleaner constructed in accordance with a third embodiment of the present invention.

Referring to the drawings wherein the showings are for purpose of illustrating the third preferred embodiment of the present invention only, and not for purpose of limiting the same, FIG. 12 perspectively illustrates a vacuum cleaner B10 constructed in accordance with the present invention. The vacuum cleaner B10 comprises a cleaning head portion B12 and an upright portion B14. The vacuum cleaner B100 of the present invention is used by pushing the cleaning head portion B12 over the surface or floor covering to be cleaned with a handle B16 attached to the upright portion B14 thereof.

Figure 13:
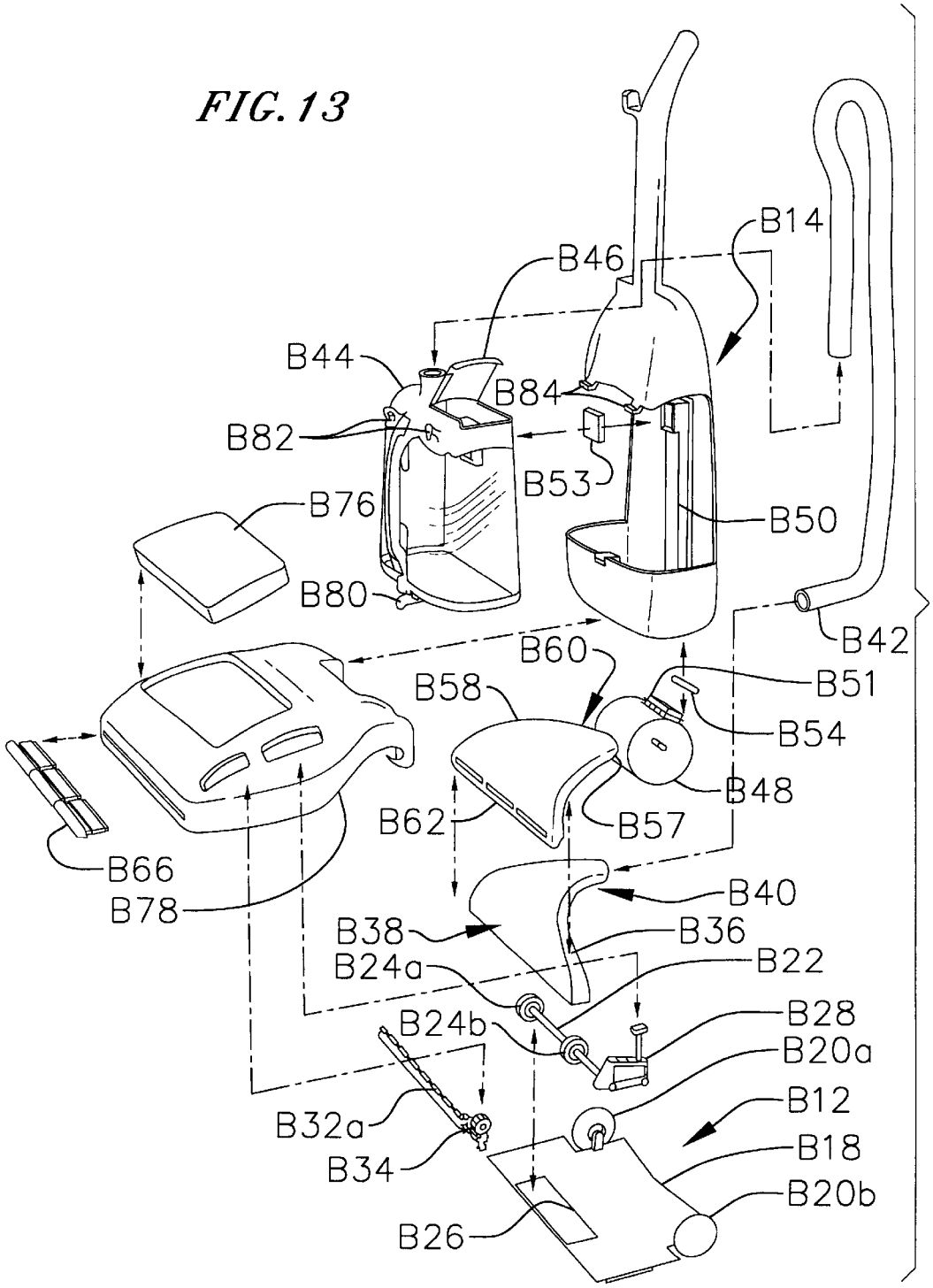
FIG. 13 is an exploded perspective view of the vacuum cleaner according to the above third preferred embodiment of the present invention.

Referring to FIG. 13, the cleaning head portion B12 has a generally rectangular floor plate B18 that supports a pair of rotatable rear wheels B20*a* and B20*b* placed at opposite corners of the floor plate B18. Also attached to the floor plate B18 is a front axle B22 supporting a pair of rotatable front wheels B24*a* and B24*b*. The axle 22 is attached to floor plate 18 in a position whereat each of the front wheels B24*a* and B24*b* protrude through an opening B26 formed within floor plate B18. The front wheels B24*a* and B24*b*, as well as rear wheels B20*a* and B20*b*, are configured to travel and support the floor plate B18 and cleaning head portion B12 above the floor covering. Additionally, the front axle B22 is attached to a vertical height adjustment mechanism B28 that is capable of selectively adjusting the height of the floor plate B18 above the floor covering. Specifically, the height adjustment mechanism B28 can change the vertical spacing between the floor plate B18 and the axle B22 in order to move the cleaning head portion B12 either closer to or further away from the floor covering.

Figure 14:
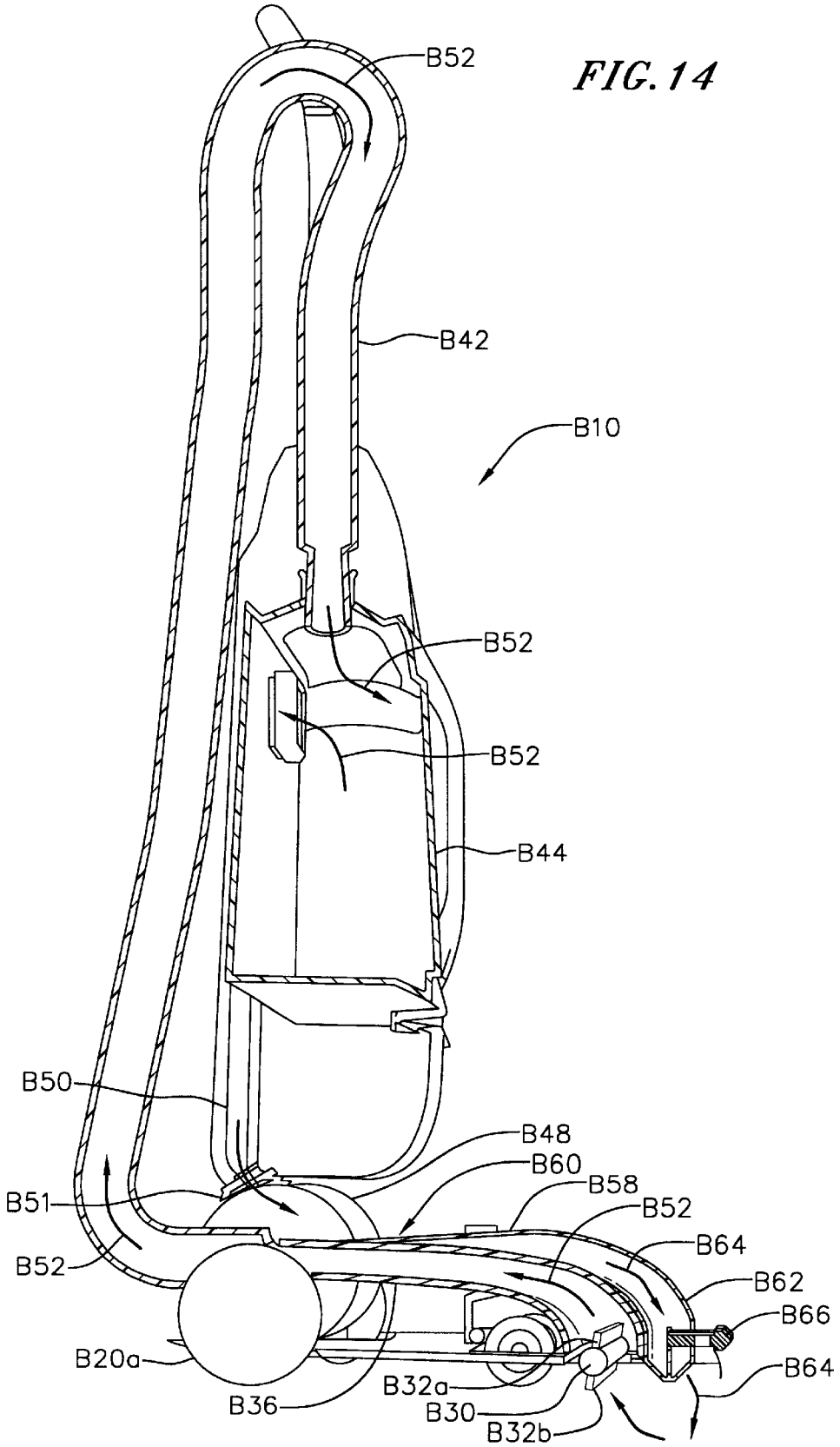
FIG. 14 is a sectional side view of the vacuum cleaner according to the above third preferred embodiment of the present invention.

Disposed within opening 26 and adjacent to front wheels B24*a* and B24*b* is an agitator B30. As seen in FIG. 14, the agitator B30 is an elongate tube with a first row of brushes B32*a* and a second row of brushes B32*b* disposed on the exterior surface thereof. The first row of brushes B32*a* are attached in opposite relation (i.e., about 180 degrees) to the second row of brushes B32*b* along the exterior of the agitator B30. The first row of brushes B32*a* may be series of firm brushes to be used on thick, shag carpeting and the second row of brushes may be soft brushes to be used on delicate floors. The agitator B30 does not rotate as in a conventional vacuum cleaner. Specifically, the first or second row of brushes B32*a*, are selected with brush selector lever B34 to comb the floor to be cleaned. The brush selector lever B34 selectively positions the agitator B30 between a first position whereat the first row of brushes B32*a* are in contact with the floor and a second position whereat the second row of brushes B32*b* are in contact with the floor. Additionally, the agitator B30 is coupled to the vertical height adjustment mechanism B28 so that the agitator B30 is at the same height above the floor covering as the front wheels B24*a* and B24*b*.

In order to draw dust and debris into the vacuum cleaner B10, an air inlet B36 is attached to the floor plate B18. As seen in FIGS. 13 and 14, the air inlet B36 is in fluid communication with the opening B26 such that dirt and debris may be drawn through opening B26 and into inlet B36. The inlet B36 is disposed over the agitator B30 such that dirt and/or debris disturbed by agitator B30 is immediately drawn into the inlet B36. As seen in FIG. 2, the air inlet B36 has a generally hollow, bell shaped configuration whereby a lower portion B38 thereof is shaped as an elongate rectangular opening that tapers into a narrow cylindrical upper portion B40. Additionally, the upper portion B40 is angled approximately ninety degrees relative to the bottom portion to facilitate connection to a flexible hose B42.

In the third preferred embodiment of the present invention, the hose B42 is coupled between the inlet B36 and a top attachment point of an airtight dustbin B44. As seen in FIG. 13, the dustbin B44 is attachable to the upright portion B14 of vacuum cleaner B10 through the use of a springclip B80, slots B82 and tabs B84. The tabs B84 of upright portion B14 are insertable into the slots B82 of dustbin B44 such that the dustbin B44 can be swung into place on upright portion B14. The springclip B80 thereby frictionally secures the dustbin B44 to the upright portion B14. The dustbin B44 is an airtight container that uses a loose plastic mesh to collect debris that is drawn into the air inlet B36 and hose B42. The dustbin B44 includes a hinged lid B46 that is openable to provide access into the container for removal of dirt and debris when the dustbin B44 is removed from the upright portion B14.

In order to draw dirt and debris into the dustbin B44, the vacuum cleaner B10 is equipped with a blower or motor B48 fluidly connected to the dustbin B44 through a duct B50. The duct B50 is formed within the upright portion B14 and fluidly connects the dustbin B44 to an intake B51 of the motor B48. The motor B48 contains fan (not shown) that rotates to produce a low pressure input streams B52 of air seen in FIG. 14. The low pressure input stream B52 draws dust and debris through the inlet B36 and hose B42 such that the dust and debris is deposited within the dustbin B44. In order to trap the dust within the dustbin B44, there is provided a first filter B53 disposed between the dustbin B44 and the duct B50. Additionally, a second filter B54 is disposed between the duct B50 and the intake B51 of motor B48. The second filter B54 is located within a flexible coupling B55 that attaches intake B51 of the motor B48 to the duct B50. The first B53 and second B54 filters prevent debris from entering and damaging the motor B48 as well as the trap dust.

Figure 15A:
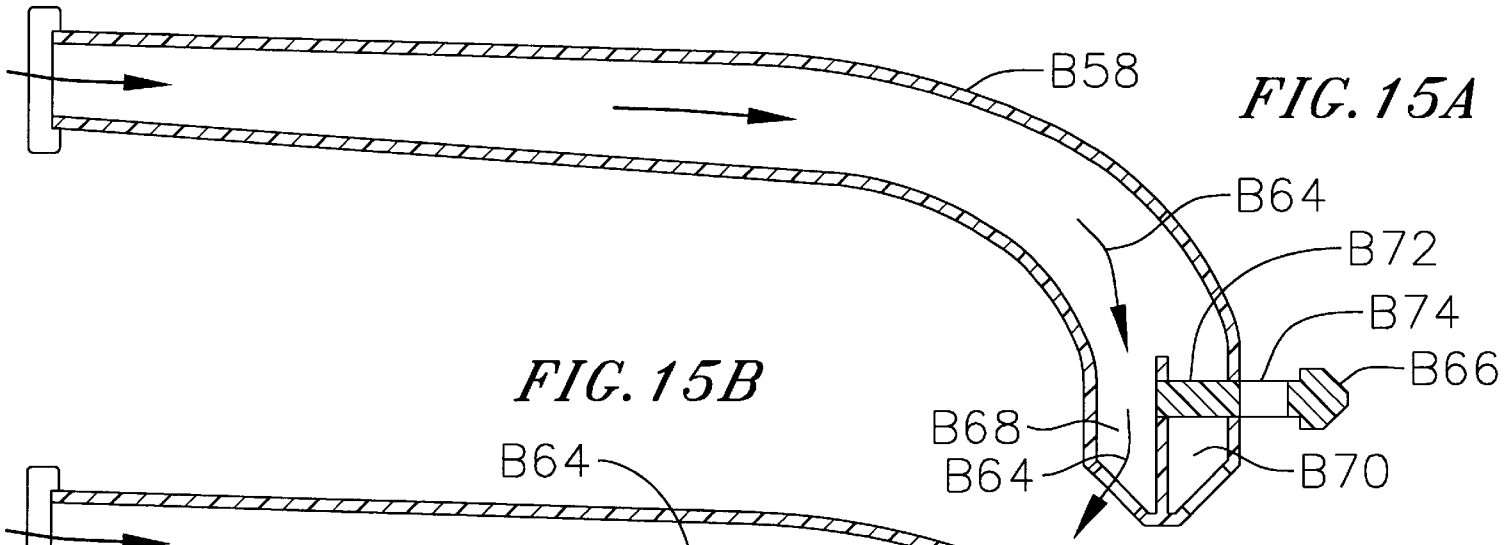
FIGS. 15A and 15B are sectional side views of the outlet for the vacuum cleaner according to the above third preferred embodiment of the present invention.
Figure 15B:
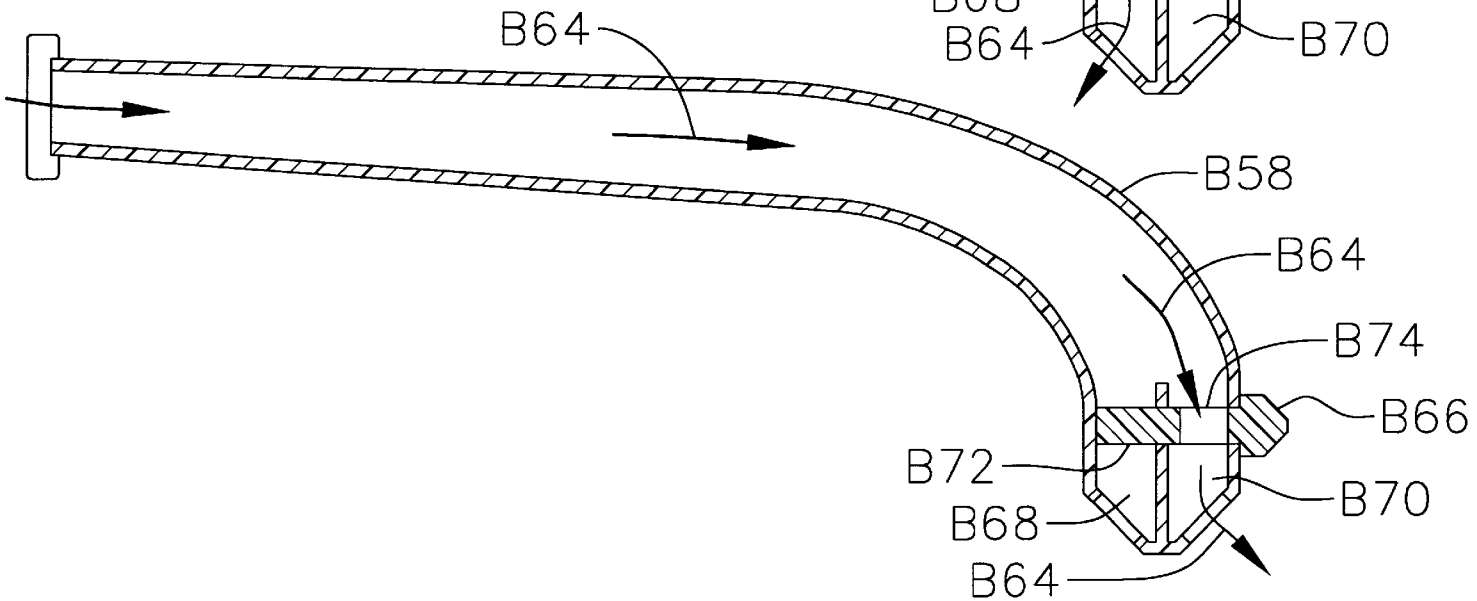

The motor B48 produces an output stream B64 of air through an exhaust port B57 of motor B48. The exhaust port B57 is fluidly connected to an air return outlet B58 that is a generally hollow, bell shaped housing that has a narrowed upper portion B60 angled approximately ninety degrees to a rectangular lower portion B62. The outlet B58 directs an output stream B64 of air adjacent to and in front of the input stream B52, as seen in FIG. 14. The outlet B58 is configured to direct the output stream B64 towards the inlet B36 during normal operation. As seen in FIG. 15A, the outlet B58 has a rear deflection channel B68 and a forward deflection channel B70. The output stream B64 can be deflected into one of the two channels (i.e., rear deflection channel B68 or forward deflection channel B70) depending upon the position of a selector or slidable edge detection button B66. The edge detection button B66 has a closed portion B72 that blocks the output stream B64 from entering a respective channel and an open portion B74 that allows output stream B64 to enter a respective channel. Therefore, by laterally sliding the edge detection button B66 between the rear deflection channel B68 and forward deflection channel B70, the output stream B64 can be directed through a respective channel. In the preferred embodiment of the present invention, the detection button B66 is positioned to allow the output stream B64 to exit the rear deflection channel B68 during normal vacuuming. However, as seen in FIG. 15*b*, if the vacuum cleaner is pressed up against a wall, the edge detection button B66 will contact the wall and slide rearward thereby closing the rear deflection channel B68 and opening the forward detection channel B70. As such, the output stream B64 will be directed towards the front of the vacuum cleaner B10 to thereby blow out dirt and debris that has collected between the wall and the floor that can then be collected by inlet B36. Therefore, the vacuum cleaner B10 constructed in accordance with the present invention does not need special tools or attachments for cleaning the junction between the wall and the floor.

Since the vacuum cleaner B10 constructed in accordance with the preferred embodiment of the present invention reuses the exhaust output stream B64, the motor B48 may be sized appropriately. As will be recognized to those of ordinary skill in the art, the motor B48 may be smaller and consume less energy than a conventional vacuum cleaner since it does not power a spinning agitator. Therefore, it is contemplated that the motor B48 may be powered by a rechargeable battery B76 mounted within a hood B78. As seen in FIG. 13, the hood B78 covers the top of the cleaning head portion B12 when attached thereto. The battery B76 is attached to the top of the hood B78 for easy recharging. If the vacuum cleaner B10 is used with a battery B76, then the battery B76 will be designed to operate at 12 volts, 7 amp/hours for the duration of at least 1 hour in order to sustain the motor B48 with 120 volts at 6 amps and spinning at 25,000 RPM.

Figure 16:
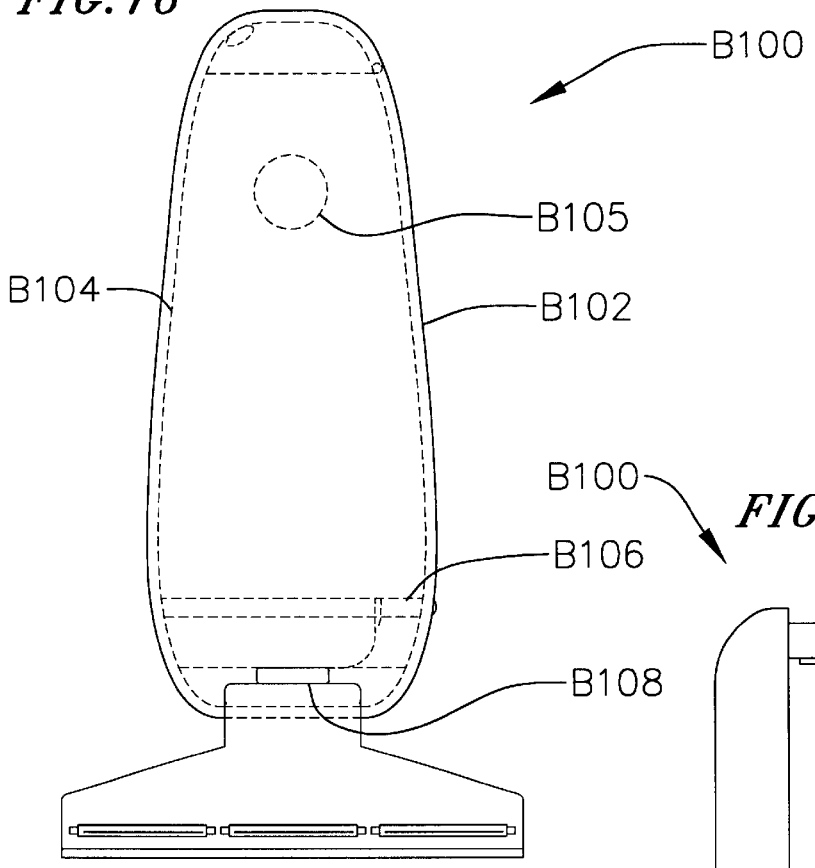
FIG. 16 is a front view of the vacuum cleaner attachment constructed in accordance with the above third preferred embodiment of the present invention.
Figure 17:
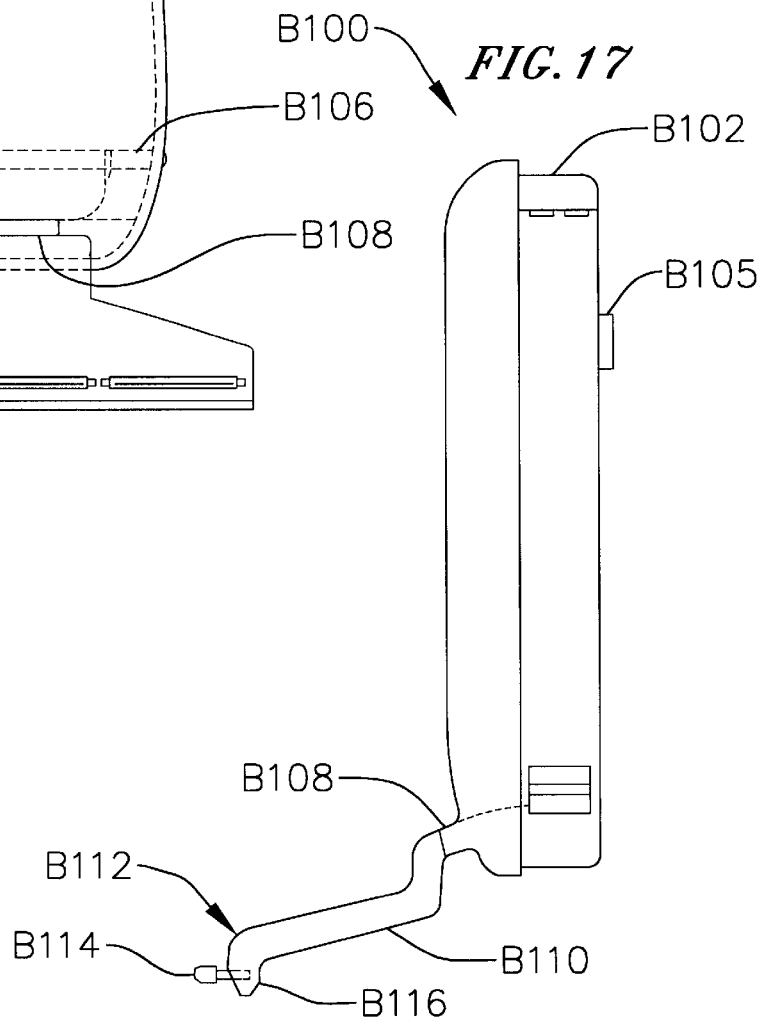
FIG. 17 is a side view of the vacuum cleaner attachment according to the above third preferred embodiment of the present invention.

In accordance with the third preferred embodiment of the present invention, as shown in FIGS. 16 and 17, there is also provided an air return accessory B100 for attachment to an existing vacuum cleaner. The air return accessory B100 comprises a front housing B102 that is attachable to the upright portion of an existing vacuum cleaner such as an Eureka World VAC. Specifically, the front housing B102 replaces the existing upright body cover and disposable bag of the vacuum cleaner. The front housing B102 snaps into the upright portion using a standard spring loaded handle/clip apparatus (not shown). The front housing B102 contains an airtight accessory dustbin B104 that is coupled to the inlet of the existing vacuum cleaner through adaptive orifice B105. The input air flows through the dustbin B104 and is filtered by an accessory filter B106 before exiting the dustbin B104 through accessory exhaust opening B108. An accessory outlet B110 is coupled to the accessory exhaust B108 in order to direct the exhaust toward the existing air inlet of the vacuum cleaner. The accessory outlet B110 has a forward lip B112 that projects downwardly in front of the air inlet of the existing vacuum cleaner. Additionally, the accessory outlet B110 is configured with an accessory edge detection button B114 that directs the output stream either forward or rearward. The accessory outlet B110 and accessory edge detection button B114 operate identically to the edge detection button B66 and outlet B58 of the vacuum B10. The accessory edge detection button B144 will direct the exhaust stream rearward through an accessory rear channel B116 during normal operation and forward through an accessory forward channel B118 when the accessory outlet B110 is in contact with a wall or obstruction and the accessory edge detection button B114 is depressed. When the accessory dustbin B104 has been filled with dust and debris, it may be emptied through a hinged lid (not shown).

Additional modifications and improvements of the first, second and third embodiment of the present invention, such as adapting the outlet for use on a canister type vacuum cleaner, may also be apparent to those of ordinary skill in the art. Thus, the particular combination of parts described and illustrated herein is intended to represent only certain embodiments of the present invention, and is not intended to serve as limitation of alternative devices within the spirit and scope of the invention.

What is claimed is:

1. A vacuum cleaner for cleaning dirt from a floor, comprising:

a blower assembly, including an intake port and an exhaust port, that draws a low pressure input air stream through the intake port and outputs a high pressure output air stream through the exhaust port;

a vacuum inlet in fluid communication with the intake port and disposed adjacent to the floor;

an outlet, in fluid communication with the exhaust port and disposed adjacent to the vacuum inlet and the floor, that directs the output stream onto the floor adjacent to the vacuum inlet to agitate the dirt adjacent to the vacuum inlet, the outlet including a forward deflection channel, a plurality of rearward deflection channels, and a selector configured to selectively connect the exhaust port to one of the forward deflection channel and the rear deflection channels; and a filter that collects and filters incoming dirt and debris.

2. A vacuum cleaner for cleaning dirt from a floor, comprising:

a blower assembly, including an intake port and an exhaust port, that draws a low pressure input air stream through the intake port and outputs a high pressure output air stream through the exhaust port;

a vacuum inlet in fluid communication with the intake port and disposed adjacent to the floor;

an outlet, in fluid communication with the exhaust port and disposed adjacent to the vacuum inlet and the floor, that directs the output stream onto the floor adjacent to the vacuum inlet to agitate the dirt adjacent to the vacuum inlet, the outlet including a forward deflection channel, a rear deflection channel, and a selector configured to selectively connect the exhaust port to one of the forward deflection channel and the rear deflection channel; and a filter that collects and filters incoming dirt and debris.

3. A vacuum cleaner as claimed in claim 2, wherein the filter is in fluid communication with the vacuum inlet and the intake port and is configured to filter the dirt before the dirt exits through the outlet.

4. A vacuum cleaner as claimed in claim 2, wherein the filter includes a dustbin in fluid communication with the vacuum inlet and the intake port and is disposed therebetween.

5. A vacuum cleaner as claimed in claim 2, wherein the blower assembly comprises a plurality of blowers associated with respective pluralities of intake ports and outlet ports.

6. A vacuum cleaner as claimed in claim 1, wherein the forward deflection channel directs the output air stream in front of the vacuum cleaner.

7. A vacuum cleaner as claimed in claim 2, wherein the forward deflection channel directs the output air stream in front of the vacuum cleaner.

8. An air return attachment for use with a vacuum cleaner having a vacuum inlet for drawing in dirt from a floor and an exhaust port for generating an output stream of air, the air return attachment comprising:

a housing attachable to the vacuum inlet and to the exhaust port; and an outlet, in fluid communication with the housing and disposed adjacent to the vacuum inlet, that directs the output stream onto the floor adjacent to the vacuum inlet to agitate the dust adjacent to the vacuum inlet, the outlet including a forward deflection channel, a rear deflection channel, and a selector configured to selectively connect the exhaust port to one of the forward deflection channel and the rear deflection channel.

9. A method of cleaning dirt from a floor with a vacuum having a blower assembly, a vacuum inlet, a filter and an outlet disposed adjacent to the vacuum inlet having a forward deflection channel and a rear deflection channel, the method comprising the steps of:

a) generating a low pressure input stream of air through the vacuum inlet with the blower assembly;

b) drawing dirt into the vacuum inlet with the input stream;

c) removing the dirt from the input stream with the filter;

d) generating an output stream from the input stream with the blower assembly; and e) directing the output stream through the outlet and selectively through the rear deflection channel onto the floor adjacent to the vacuum inlet in order to agitate dirt adjacent to the vacuum inlet.

10. A method of cleaning dirt from a floor with a vacuum as claimed in claim 9, comprising the step of:

f) directing the output stream in front of the vacuum cleaner with the forward deflection channel when the vacuum cleaner is positioned adjacent to a wall.

11. A vacuum cleaner as claimed in claim 2, wherein the blower assembly comprises a motor and a fan.

12. A vacuum cleaner for cleaning dirt from a floor, comprising:

a blower assembly, including an intake port and an exhaust port, that draws a low pressure input air stream through the intake port and outputs a high pressure output air stream through the exhaust port;

a vacuum inlet in fluid communication with the intake port and disposed adjacent to the floor;

an outlet, in fluid communication with the exhaust port and disposed adjacent to the vacuum inlet and the floor, that directs the output stream onto the floor adjacent to the vacuum inlet to agitate the dirt adjacent to the vacuum inlet; and a brush defining a perimeter that substantially surrounds the vacuum inlet and the outlet.

13. A vacuum cleaner as claimed in claim 12, wherein the vacuum inlet comprises a plurality of vacuum inlets, the outlet comprises a plurality of vacuum outlets and the brush defines a perimeter that substantially surrounds the vacuum inlets and the outlets.

14. A vacuum cleaner as claimed in claim 13, wherein the brush includes portions located between adjacent vacuum outlets.

15. A vacuum cleaner as claimed in claim 12, wherein the outlet defines an interior outlet, the vacuum cleaner further comprising:

an exterior outlet, in fluid communication with the exhaust port and disposed adjacent to the floor, located outside the perimeter defined by the brush.

16. A vacuum cleaner as claimed in claim 15, further comprising:

a device that selectively blocks one of the interior outlet and the exterior outlet.

17. A vacuum cleaner as claimed in claim 12, further comprising:

a filter that collects and filters incoming dirt and debris.

18. A vacuum cleaner as claimed in claim 12, wherein the blower assembly comprises a motor and a fan.

19. A vacuum cleaner for cleaning dirt from a floor, comprising:

a blower assembly, including an intake port and an exhaust port, that draws a low pressure input air stream through the intake port and outputs a high pressure output air stream through the exhaust port;

a vacuum inlet in fluid communication with the intake port and disposed adjacent to the floor;

first and second outlets, in fluid communication with the exhaust port and disposed adjacent to the vacuum inlet and the floor, that direct the output stream onto the floor adjacent to the vacuum inlet to agitate the dirt adjacent to the vacuum inlet; and a device that selectively blocks one of the first and second outlets.

20. A vacuum cleaner as claimed in claim 19, further comprising:

a brush located between the first and second outlets.

21. A vacuum cleaner as claimed in claim 19, wherein the first outlet is located in front of the second outlet and the device is adapted to block the second outlet when the vacuum cleaner is positioned relative to a wall such that a portion of the device engages the wall.

22. A vacuum cleaner as claimed in claim 19, further comprising:

a filter that collects and filters incoming dirt and debris.

23. A vacuum cleaner as claimed in claim 19, wherein the blower assembly comprises a motor and a fan.

* * * * *